US006098371A

United States Patent [19]

Cassoli et al.

[11] Patent Number: 6,098,371

[45] Date of Patent: Aug. 8, 2000

[54] AUTOMATIC MACHINE FOR THE INDIVIDUAL PACKAGING OF ROLLS OF PAPER OR SIMILAR CYLINDRICAL PRODUCTS

[75] Inventors: Paolo Cassoli, Casalecchio Di Reno; Giordano Gorrieri, Pianoro; Giorgio Bonafe', Caselecchio Di Reno; Gianni Mantovani, Monte San Pietro, all of Italy

[73] Assignee: Casmatic S.p.A., Italy

[21] Appl. No.: 09/103,572

[22] Filed: Jun. 24, 1998

[30] Foreign Application Priority Data

Jul. 2, 1997 [IT] Italy ..... BO97A0408

[51] Int. Cl.[7] ..... B65B 11/32; B65B 59/00

[52] U.S. Cl. ..... 53/234; 53/201; 53/204; 53/228

[58] Field of Search ..... 53/234, 232, 233, 53/225, 228, 466, 461, 204, 409, 168, 590, 201

[56] References Cited

U.S. PATENT DOCUMENTS

| | | | |
|---|---|---|---|
| 2,623,339 | 12/1952 | Sandberg | 53/234 |
| 2,749,692 | 6/1956 | Conti | 53/234 |
| 3,248,847 | 5/1966 | Niepmann et al. | 53/234 X |
| 4,426,825 | 1/1984 | Nordstrom . | |
| 4,995,223 | 2/1991 | Spatatfora et al. | 53/234 X |
| 5,024,046 | 6/1991 | Spatafora et al. | 53/234 X |
| 5,493,847 | 2/1996 | Spatatfora | 53/234 X |

FOREIGN PATENT DOCUMENTS

| | | |
|---|---|---|
| 0444229 A1 | 9/1991 | European Pat. Off. . |
| 0503215 A1 | 9/1992 | European Pat. Off. . |
| 19502562 A1 | 8/1996 | Germany . |
| 2010769 | 7/1979 | United Kingdom . |
| 20689883 | 8/1981 | United Kingdom . |

*Primary Examiner*—James F. Coan
*Attorney, Agent, or Firm*—Larson & Taylor

[57] ABSTRACT

The machine comprises a main carousel including a horizontal axis having seats which are angularly equidistant and open outwardly and including at the front a gripper and at the rear a folding device. Each seat passes first adjustable means with the gripper open to supply the gripper with a packaging sheet arranged on the seat, and cooperating with a first auxiliary carousel which inserts a roll into each seat, oriented with its axis parallel to that of the main carousel, while the roll is partially wrapped with the packaging sheet retained by the closed gripper. In succession, the rear folding device intervenes and the gripper opens and folding means intervene in order to fold the front edge of the sheet onto the rear edge, while the folding device returns to the rest position and the edges are fixed together by a heat-sealing carousel. The seats then pass opposite the folding devices which fold and arrange on one another several end portions of the tubular sheet and then the packaged roll is unloaded by a second auxiliary carousel which transfers it to downstream conveying means for heat-sealing the end folds of the package.

30 Claims, 18 Drawing Sheets

AUTOMATIC MACHINE FOR THE INDIVIDUAL PACKAGING OF ROLLS OF PAPER OR SIMILAR CYLINDRICAL PRODUCTS

FIELD OF THE INVENTION

The invention relates to an automatic machine of the carousel type, in particular for the individual packaging, in a continuous and high-speed cycle and using any suitable packaging material, of rolls of paper of varying size, for example rolls of kitchen paper or toilet paper or other products which have similar requirements.

BACKGROUND OF THE INVENTION

In order to perform this type of processing operation, straight and continuous machines are currently known, for example of the type described in U.S. Pat. No. 4,426,825, said machines also packaging individually rolls of paper with a sheet of packaging material which is wound tightly around the roll itself and the edges of which are then folded over and sealed together. These machines have large dimensions in plan view and this condition may restrict the use thereof.

The object of the invention is to provide an automatic machine operating in a continuous rapid cycle, for the individual packaging of rolls of paper of varying size or other products, using a preferably heat-sealable packaging material, which has small dimensions in plan view, has a relatively simple design and is easily adjustable for adaptation to the varying size of the rolls to be packaged and which handles the rolls themselves delicately. It is stated by way of a premise that below the simplified term of "roll" will be used to indicate the roll of paper or other suitable product which can be packaged by the machine in question. The simplified term of "sheet" will also be used to indicate the sheet of material for packaging the roll.

The machine according to the invention comprises:

a) a main carousel with a horizontal axis, provided with angularly equidistant seats which are open outwards, have adjustable dimensions and are suitable for each containing a roll arranged with its axis parallel to that of the carousel itself. Each seat is provided at the front with gripper means for retaining the front transverse edge of the packaging sheet and is provided at the rear with a folding device normally in a retracted position which, upon actuation, closes the seat laterally so as to fold onto the roll the rear transverse edge of the sheet still retained by the gripper means;

b) adjustable means which in synchronism supply to the gripper means of each seat of the main carousel, a packaging sheet which has dimensions suited to the size of the roll to be packaged, obtained preferably from a reel of packaging material and which is arranged on the seat. The width and length of each sheet are suitably greater than the generatrix and diameter of the roll, respectively;

c) adjustable means for orienting the rolls with the axis transverse with respect to the feeding direction and parallel to the axis of the main carousel, into the seats of which the rolls themselves are individually inserted by a first auxiliary carousel with a horizontal axis parallel to that of the main carousel, with which it rotates in synchronism. The first auxiliary carousel is located downstream of the sheet supplying means and is provided with angularly equidistant grippers which are adjustable according to the variation in size of the rolls and which each grip the ends of a roll supplied by the supply means so as to subject the roll itself to a stress in the axial direction in which the roll itself has the greatest resistance owing to its cylindrical shape and the presence of the cardboard core. The first auxiliary carousel inserts the rolls by means of translation into each seat of the main carousel and, during this step, each roll is partially wrapped with the wrapping sheet which is retained on the seat itself by the associated front gripper;

d) adjustable means which, following the intervention of the rear folding device of each seat of the main carousel, which folds onto the roll the rear transverse edge of the sheet and following opening of the front gripper of the same seat, fold onto the roll itself the front transverse edge of the sheet which was first retained by the gripper, while in synchronism the said rear folding device returns into the rest position so as to allow the transverse edges of the sheet to be arranged on top of one another;

e) any means of the carousel type, with a horizontal axis, arranged downstream of the preceding means, so as to seal together the transverse overlapped edges of the packaging sheet;

f) means which may be adjustable, for folding onto the ends of each roll located in the seats of the main carousel, the section of the packaging sheet which projects from the same ends of the roll;

g) a second auxiliary carousel, which has a horizontal axis parallel to that of the other carousels and is similar to the first auxiliary carousel supplying the rolls and which extracts from the main carousel the packaged rolls, holding them by their ends so as to keep the closed end edges of the packaging arranged on top of one another and this carousel being designed so as to transfer the packaged rolls to means arranged downstream;

h) conveying means which are adjustable according to the variation in size of the rolls and which grip the ends of the packaged rolls unloaded by the second auxiliary carousel and which if necessary complete closing of the ends of the packaging and which if necessary seal the overlapped end edges of the wrapping of the rolls and which convey away the rolls, for example towards packing means.

According to a preferred embodiment of the invention, the seats of the main carousel are adaptable to the varying size of the rolls, with self-centering adjustment and with a variation in their depth, so that the position of the rolls themselves towards the outside and consequently with respect to the gripper of the packaging sheet and the folding device associated with each seat and with respect to the station sealing the transverse edges of the packaging sheet. The grippers of the first and second auxiliary carousel, as well as the means supplying the packaging sheet and also the means for folding over the ends portions of the packaging sheet, and finally the means for sealing these ends of the packages, are adaptable to the varying size of the rolls, with self-centring adjustments with respect to the ideal vertical center line of the main carousel.

BRIEF DESCRIPTION OF THE DRAWINGS

Further characteristic features of the invention and the advantages arising therefrom will emerge more clearly from the following description of a preferred embodiment thereof, which envisages the use of packaging material in the form of heat-sealable film and which is illustrated purely by way of a non-limiting example in the figures of the thirteen accompanying plates of drawings, in which.

DETAILED DESCRIPTION OF THE PREFERRED EMBODIMENT

With reference to FIGS. 1 to 11, the main carousel is now described.

Figure 2:
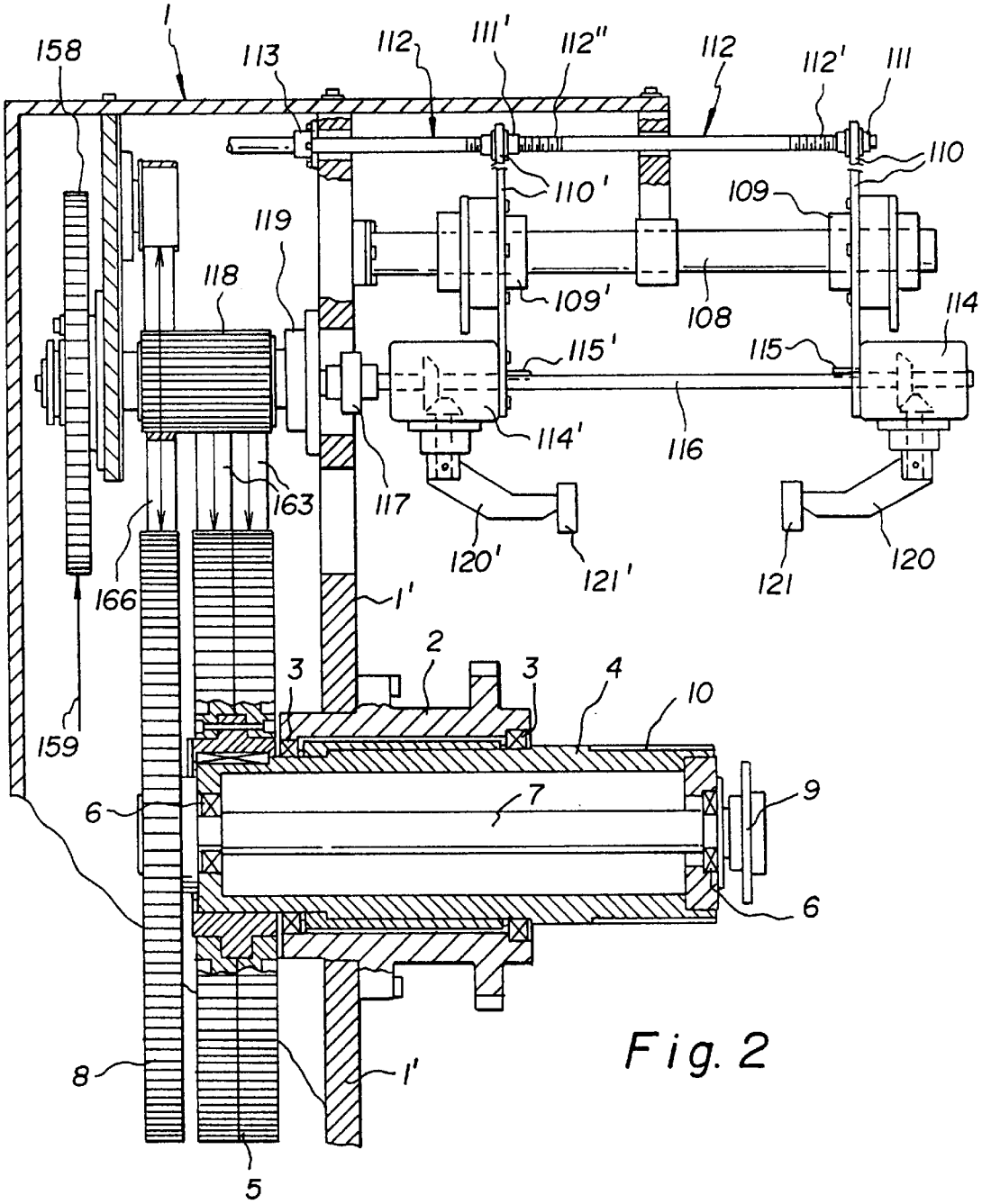
FIG. 2 illustrates the details relating to the main carousel and to the first dynamic folding devices which act on the ends of the sheet which packages the roll.

From FIG. 2 it can be seen that the entire machine has a sturdy and effective base structure 1 in the form of a casing, which has mounted inside it the drive systems and kinematic chains which operate, in synchronism and with continuous movement, the various operating stations of the machine itself, which are mounted in cantilever fashion on the side 1' of this base structure. 2 denotes the horizontal-axis bush which is fixed to the wall 1' of the base 1 and which rotatably supports with bearings 3 the spindle 4 of the main carousel G1, the end of which inside the casing 1 has keyed onto it the toothed drive pulley (see below). The spindle 4 is hollow and coaxially and rotatably supports by means of bearings 6 a shaft 7 which with one of its ends projects into the base 1 and carries, keyed onto it, the toothed drive pulley 8 (see below), while the other end of the same shaft has keyed on it a disc 9 which will be described further below and which is connected to the means which adjust the width of the seats of the main carousel according to the variation in size of the rolls to be packaged. The toothed pulleys 5 and 8 are operated by a single source of movement, described further below, have the same diameter and normally rotate in the same direction and at the same speed. The toothed pulley 8 is connected to the centralized source of movement with the intervening arrangement of means which are described further below and by means of which it is possible to obtain, upon actuation, angular phase-displacement of the rim 8 and rim 5, so as to adapt the capacity of the seats of the carousel G1 to the variation in size of the rolls to be packaged.

Figure 3:
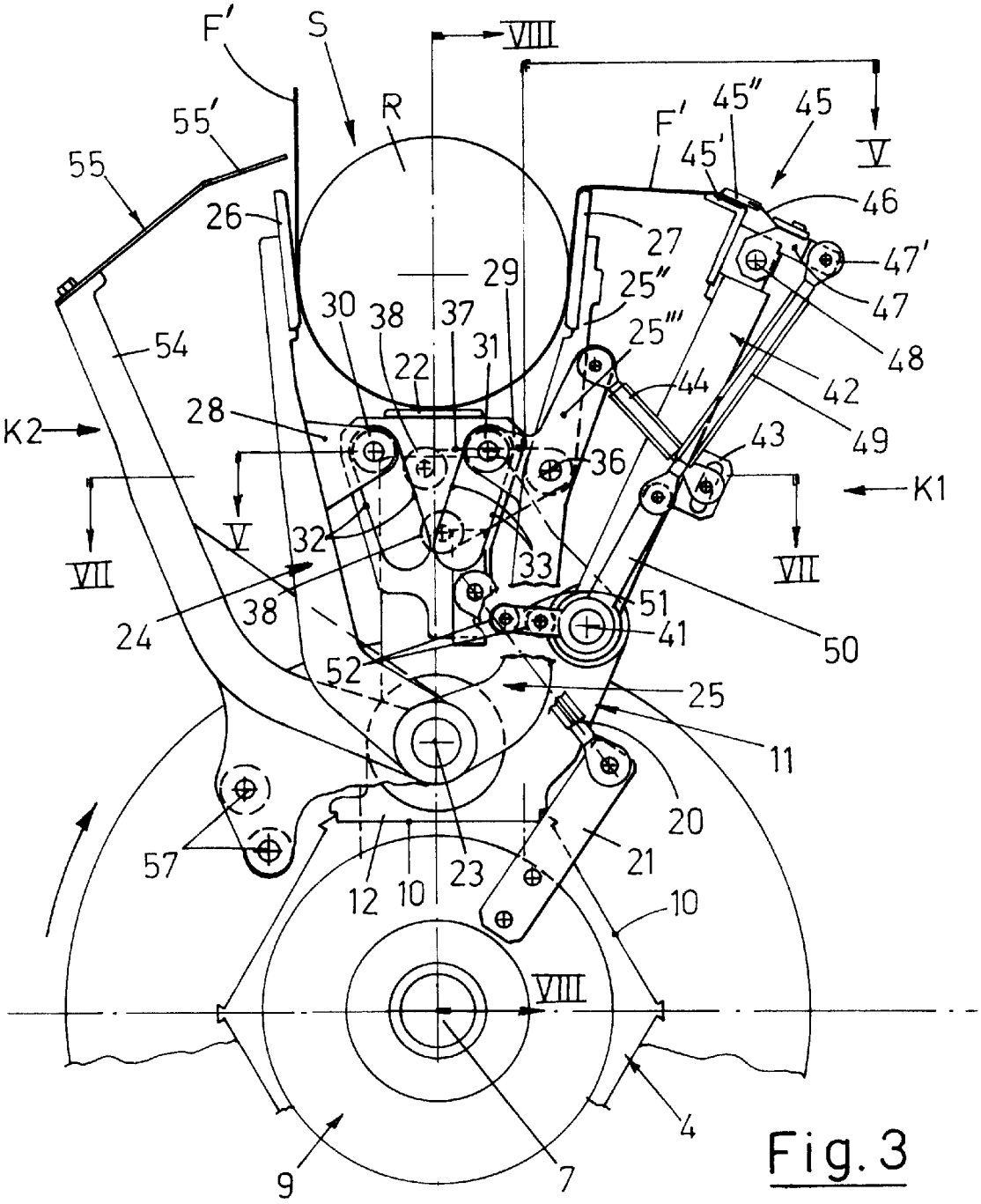
FIGS. 3 and 4 show a side elevational view, on a larger scale, of the means which make up each roll-containing seat of the main carousel, these means being shown in the two different conditions suitable for containing a large or small-sized roll, respectively.

From FIGS. 2 and 3 it can be seen that the hollow spindle section 4 which projects from the end of the bush 2 outside the base has lateral flat surfaces such that it has a cross-section which is substantially prismatic, for example hexagonal, and each flat face 10 of this spindle section is designed to support correctly oriented the bracket 11 of each seat S of the main carousel G1. From FIGS. 2, 5 and 6 it can be seen that the bracket 11 is provided with a base 12 which is fixed with screws 13 onto the abovementioned surface 10 and is provided with a pair of sides 14, 15 which are parallel to one another and to the casing 1 and interconnected by a transverse wall 16 on the middle part of which there is fixed a rectilinear slide-guiding group 17, arranged substantially radially with respect to the carousel G1. The movable part 17' of the said group 17 has fixed to it a flat cross-piece 18 which is parallel to the spindle 4 of the carousel and which passes through a window 19 formed on the external side 14 of the bracket 11 and the end projecting from the window has hinged with it a tie-rod 20 which is in turn hinged at the other end to a lever arm 21 fixed radially to the abovementioned adjusting disc 9. The top of the movable part 17' of the slide-guiding group 17 has fixed to it the cushion 22 which forms the bottom of each seat S of the carousel G1 and against which the roll to be packaged rests, arranged with its axis parallel to the said spindle 4.

Figure 4:
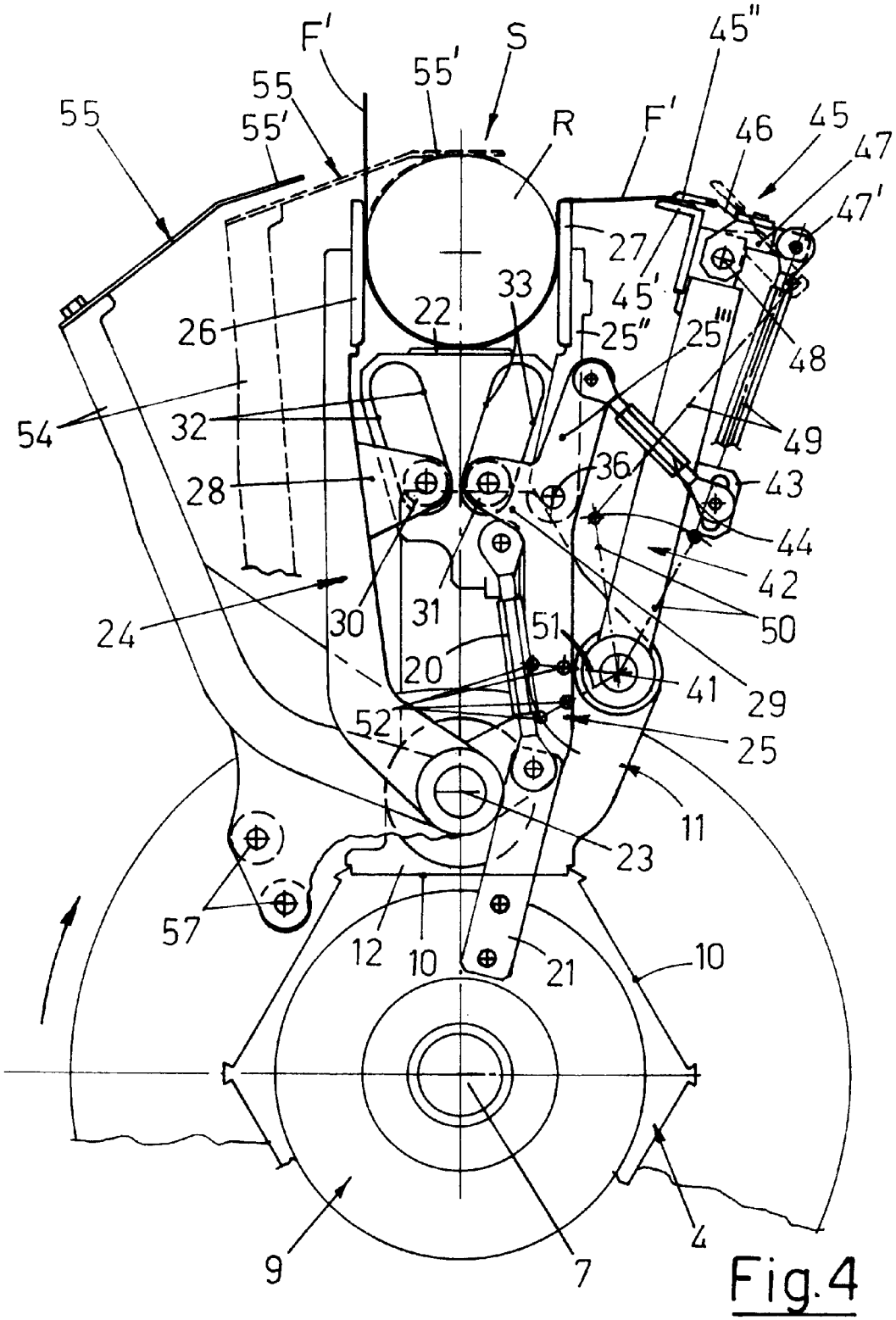
Figure 5:
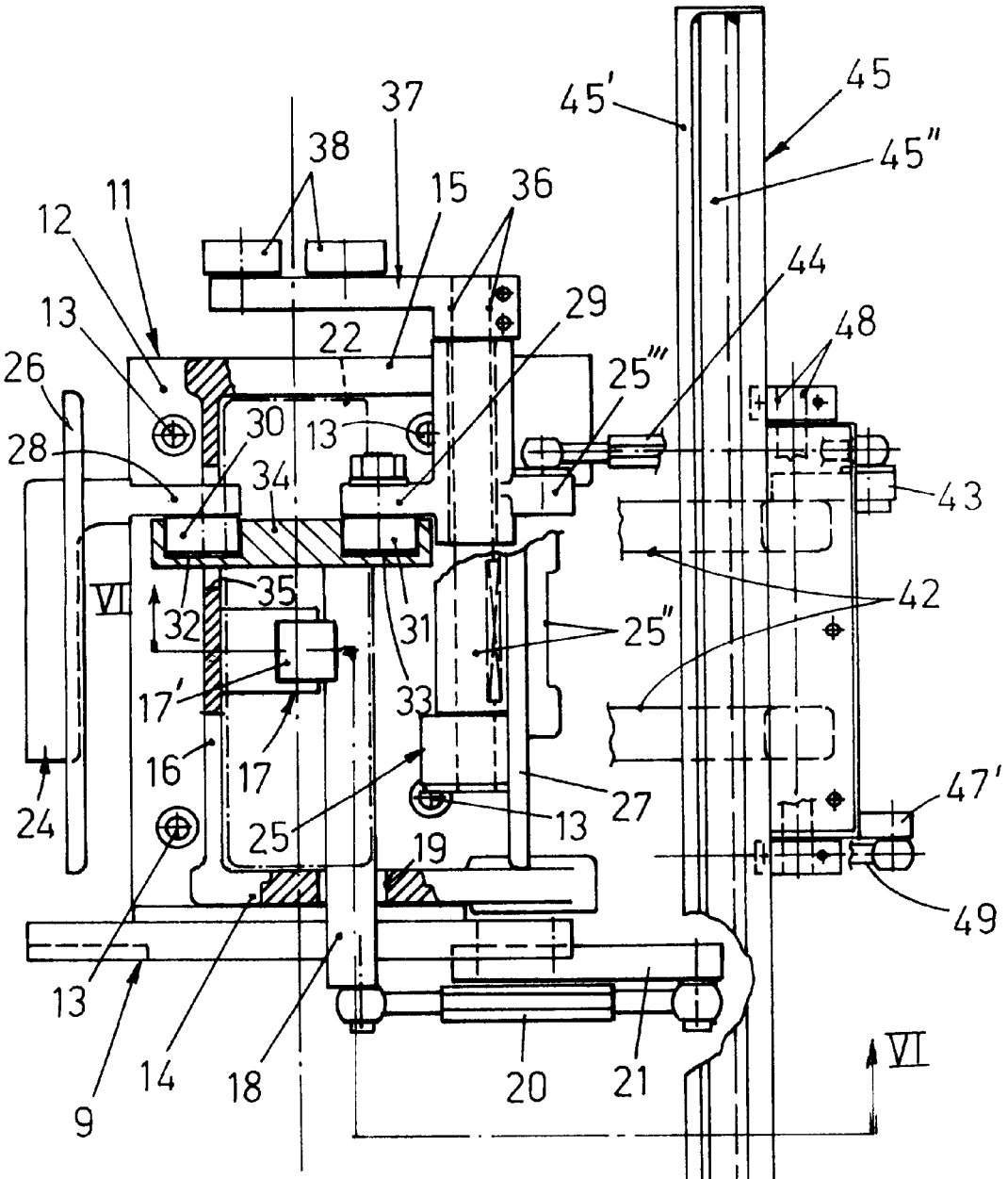
FIG. 5 shows the details of a seat of the main carousel, in a plan view partially sectioned along the line V—V of FIG. 3.
Figure 7:
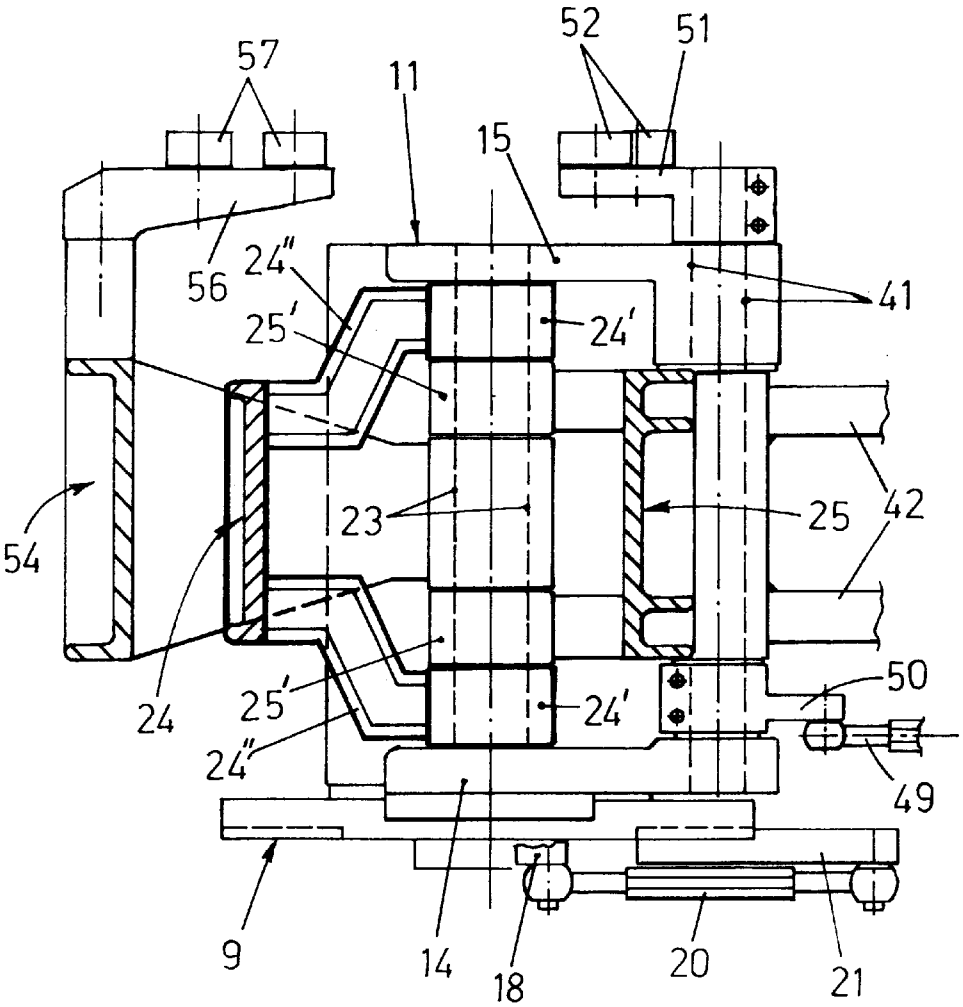
FIG. 7 shows further details of a seat of the main carousel, in a plan view and partially sectioned along the line VII—VII of FIG. 3.
Figure 6:
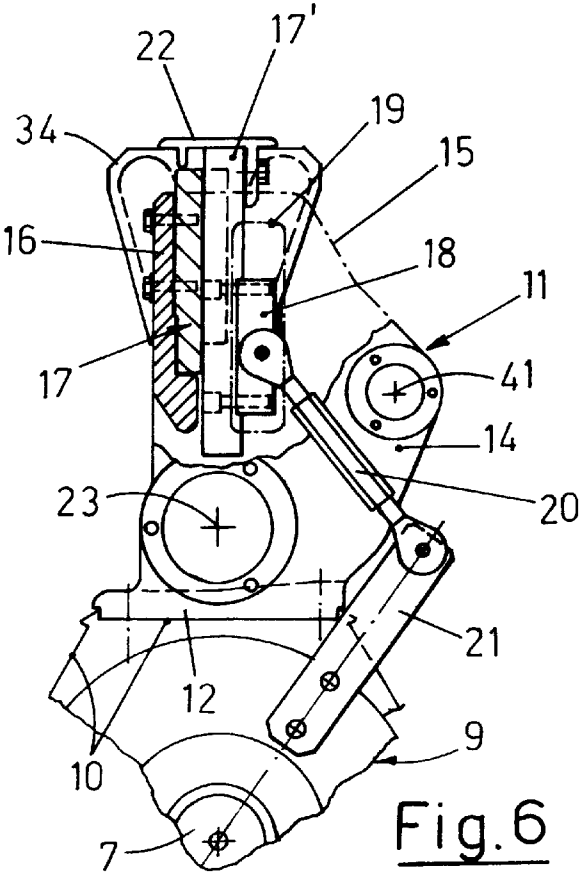
FIG. 6 shows other details of a seat of the main carousel, viewed laterally and partially sectioned along the line VI—VI of FIG. 5.
Figure 8:
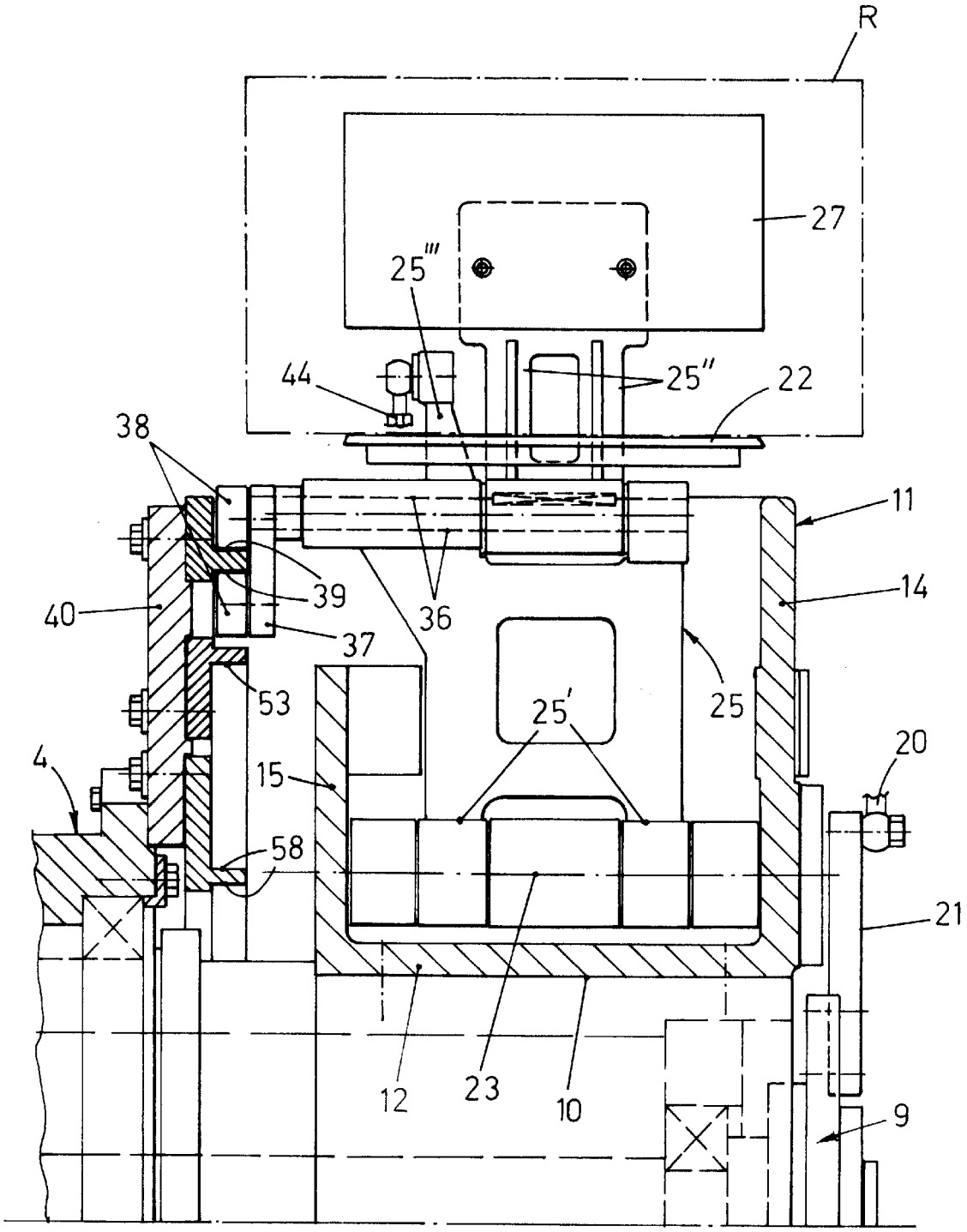
FIG. 8 shows details of a seat of the main carousel, shown partly along the cross-sectional line VIII—VIII of FIG. 3.
Figure 10:
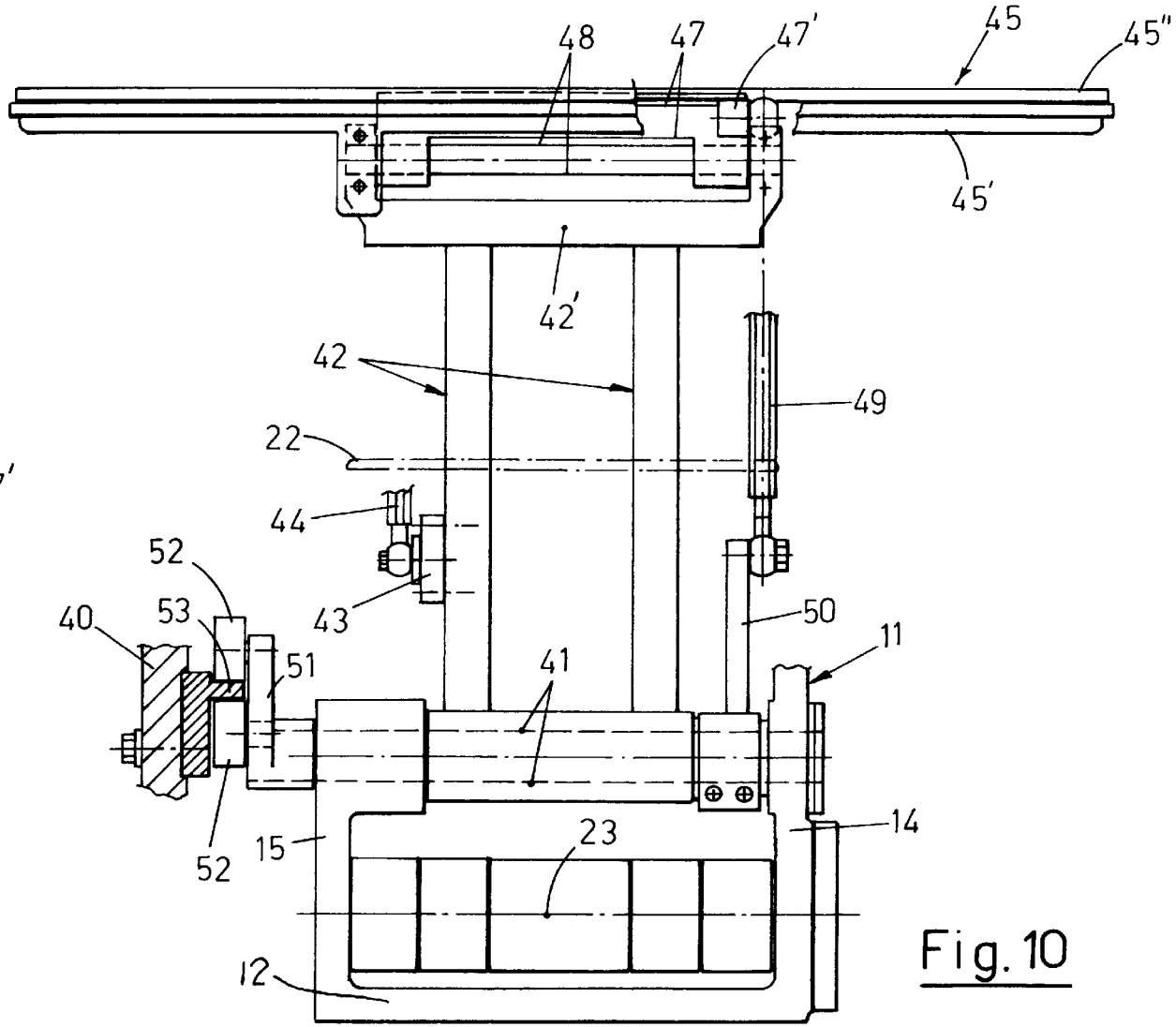
FIG. 10 is an elevational view from the front side, as indicated by the arrow K1 in FIG. 3, of the gripper of each seat of the main carousel.
Figure 9:
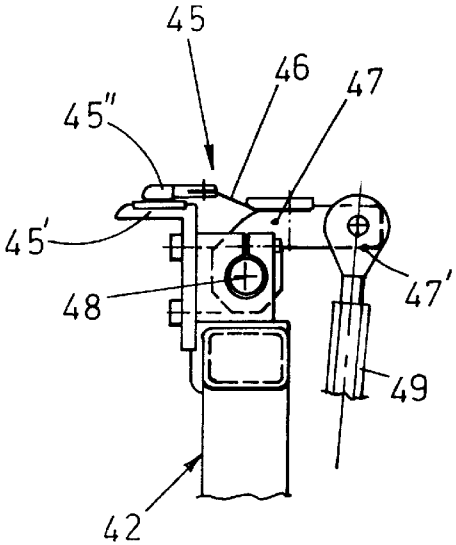
FIG. 9 shows a side view, on a larger scale, of the end and active part of the gripper mounted at the front on each seat of the main carousel.
Figure 11:
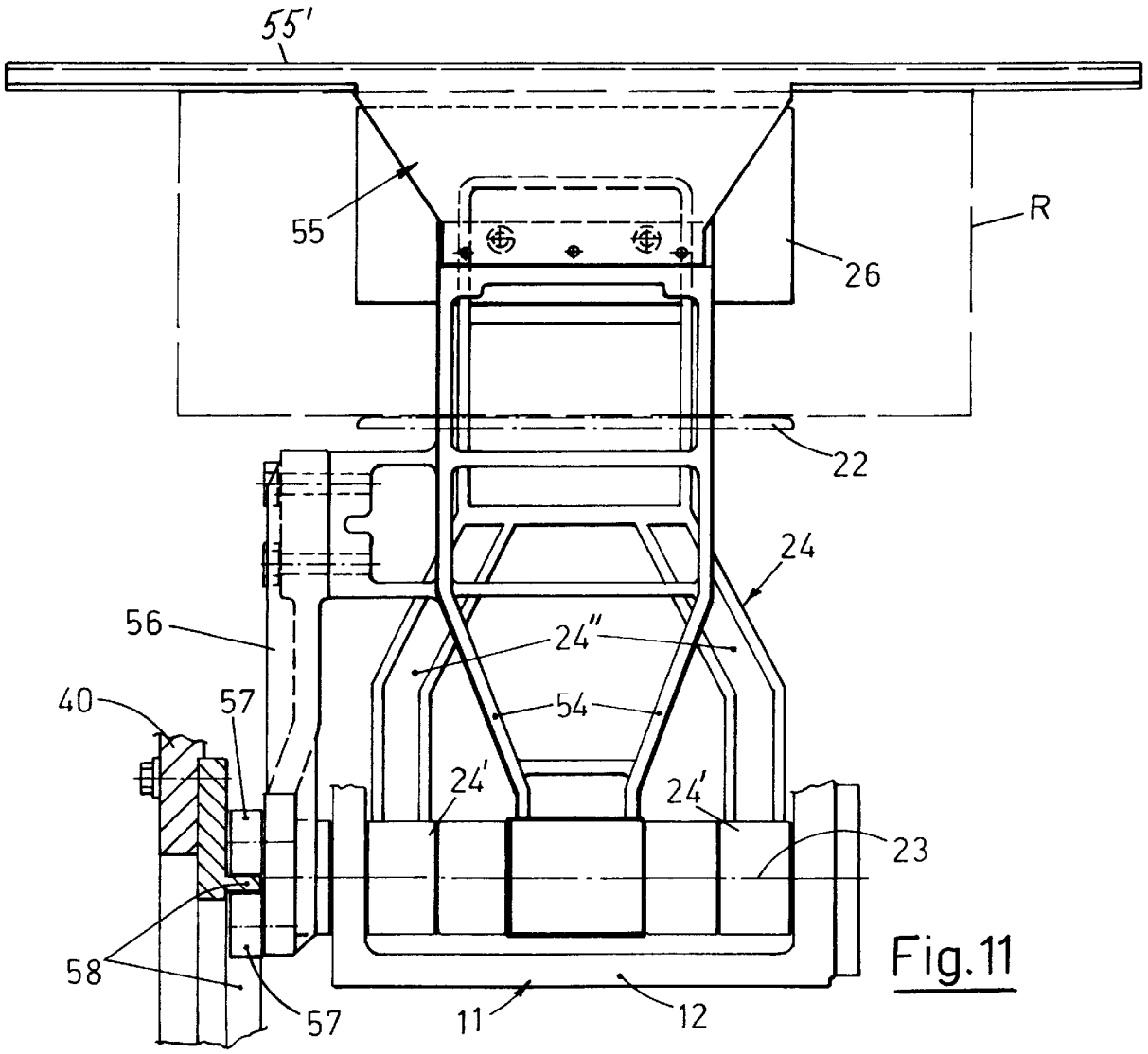
FIG. 11 is an elevational view from the rear side, as indicated by the arrow K2 in FIG. 3, of the folding device of each seat of the main carousel.

Underneath the slide-guiding group 17, the sides 14 and 15 of the bracket 11 support the ends of a spindle 23 which is parallel to the spindle 4 and on which there are hinged the ends 24' and 25' (see also FIG. 7) of respective levers 24 and 25 arranged immediately upstream and downstream of the said cushion 22 and which carry, fixed at their ends, flat jaws 26 and 27 which define the front and rear walls of the seat S and which grip laterally the roll R to be packaged. The dimensions of the seat S formed by the components 22 and 26, 27 in relation to the roll R are shown in FIGS. 8 and 11, from which it is apparent how the roll itself suitably projects from this seat both with a part of its side surface and with appropriate end sections. The levers 24 and 25 have lugs 28 and 29 facing one another and equipped with respective end rollers 30 and 31 inserted into straight and equally inclined tracks 32 and 33 diverging away from the axis of the carousel and formed on a plate 34 integral with the end of the cross-piece 18. From FIG. 5 it can be seen how the plate 34 and the lug 28 partly pass through an opening 35 of the transverse wall 16 of the bracket 11. From FIG. 3 it can be seen that, for the packaging of the largest sized rolls, the cushion 22 is in the position arranged as close as possible to the axis of the carousel and the rollers 30, 31 co-operate with the ends of the tracks 32 and 33 which are furthest away from each other. With anti-clockwise rotation of the disc 9 in FIG. 3, the cushion 22 is raised and the levers 24 and 25 move towards each other with a self-centering movement, as illustrated in FIG. 4, so that the seat S is able to contain small size rolls.

From FIGS. 3 and 8 it can be seen that the lever 25 has a section which is interrupted in the region of the lug 29 and which rotatably supports a shaft 36 parallel to the shaft 23 and which has keyed onto it the second lever section 25" which carries the jaw 27. The shaft 36 projects from the lever 25 with the end directed towards the casing 1 and carries keyed on this end a lever 37 which, with a pair of parallel rollers 38, follows the profile of an annular cam 39 fixed onto a disc 40 in turn flanged coaxially on the end outside the casing 1 of the bush 2 supporting the spindle of the carousel G1. With these means the jaw 27 may be made to oscillate by a correct amount away from the opposite jaw 26 during the steps of insertion or extraction of the roll respectively into and out of the seat S of the carousel, in order to facilitate these steps, after which the same jaw returns into the rest position, useful for clamping the roll R when the latter has been inserted into the seat S (see below).

From FIGS. 1, 3, 9 and 10 it can be seen that in front of the lever 25, the sides 14 and 15 of the bracket 11 rotatably support a shaft 41 which is parallel to the shaft 23 and on which there is rotatably mounted the end of a lever 42 provided laterally with a lug 43 hinged on the end of a tie-rod 44 which at the other end is hinged on an extension 25'" of the lever 25, such that during the step of adaptation of the seat S to the variations in size of the rolls to be packaged, the position of the gripper 45 also varies at the same time, in proportion to the diameter of the rolls. The lever 42 supports at the height of the jaw 27 a gripper 45 parallel to the axis of the carousel, directed with its opening in the direction of the seat S and with dimensions suitable for holding the front edge of the sheet for packaging the roll (see below). The gripper 45 has a width proportional to that of the packaging sheet (see below) and comprises a jaw 45' fixed to the lever 42 and having mounted on it a movable jaw 45" fixed by means of lamellar springs 46 to a bracket 47 mounted in oscillating fashion on a spindle 48 fixed onto the forked end 42' of the same lever 42, this bracket 47 being provided with a lug 47' hinged onto the end of a tie-rod 49 hinged with the other end onto a lever arm 50 fixed onto the shaft 41 which with the end directed towards the casing 1 projects laterally from the bracket 11 and carries fixed a lever 51 which, together with the rollers 52, follows the profile of an annular cam 53 fixed onto the disc 40 already considered in FIG. 8.

From FIGS. 3 and 11 it can be seen that, on the middle part of the shaft 23, there is hinged the end of a lever 54 which is arranged partly between the initial forked section 24" of the lever 24 and which extends at the rear of this lever to a point substantially at the height of the jaw 26, in order to support a folding device 55, the active part 55' of which is substantially as wide as the packaging sheet (see below) and is parallel to the said gripper 45. The lever 54 carries, fixed on the side directed towards the casing 1, a lug with a lever arm 56 which, together with a pair of rollers 57, follows the profile of an annular cam 58 fixed onto the disc (see also FIG. 8). In the rest position the folding device 55 is outside the seat S and does not modify this angular position upon variation in the size of the rolls to be packaged, as can be seen from FIGS. 3 and 4. When it intervenes, the folding device 55 performs a fixed travel movement, positioning itself above the associated seat S and with its active part 55' in a substantially opposite and parallel condition with respect to the cushion 22. From FIGS. 3 and 4 it is obvious how, with a variation in the size of the rolls to be packaged, the rolls themselves remain tangential and inside the path followed by the active part 55, of the folding device 55.

Figure 1A:
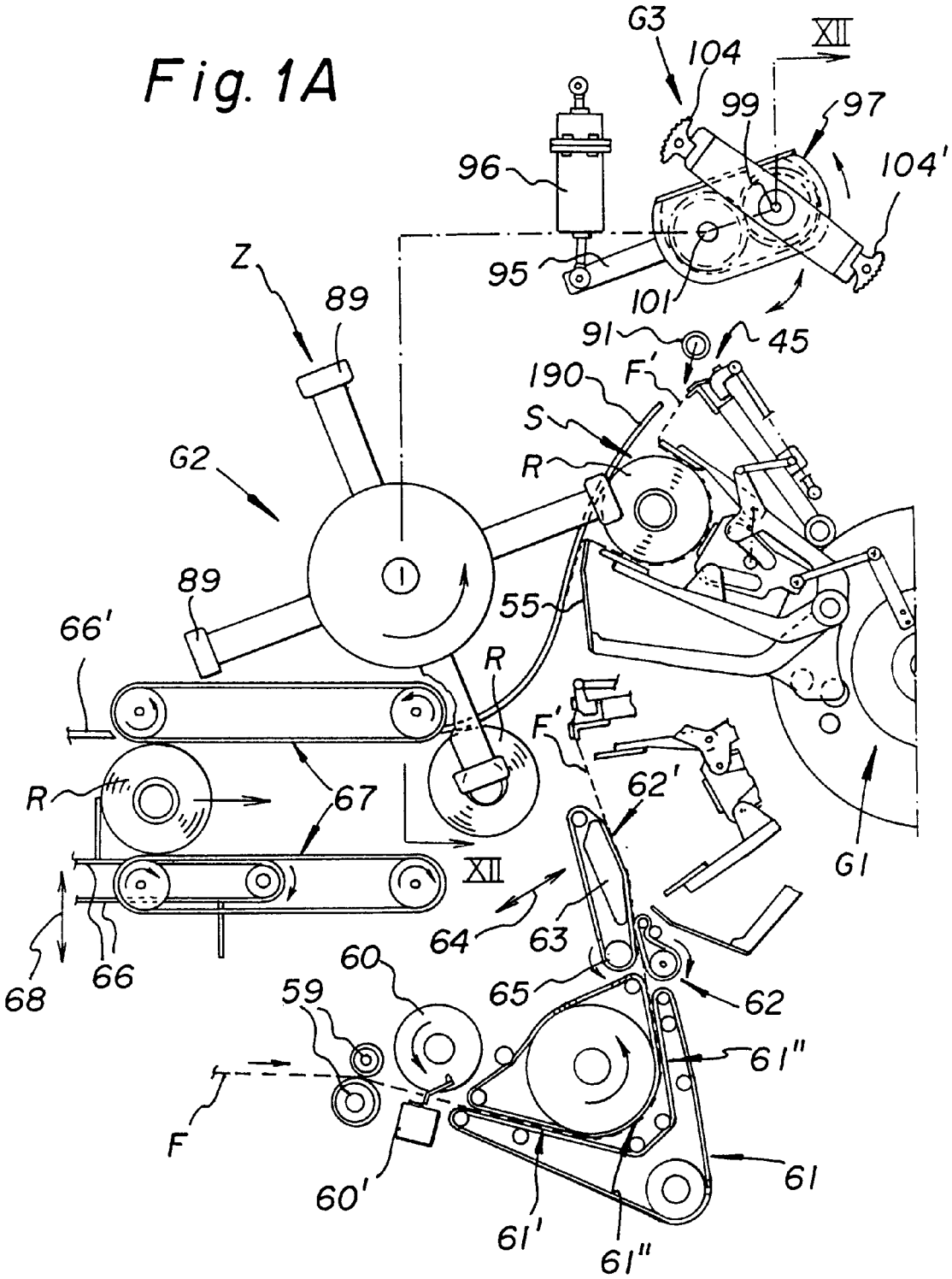
FIG. 1 (which for reasons of space and clarity, has been divided in two sheets, namely FIG. 1A and FIG. 1B, but which will be hereinafter simply referred to as "FIG. 1") is a diagrammatic side view of the various means which make up the machine, as listed in the introduction.
Figure 1B:
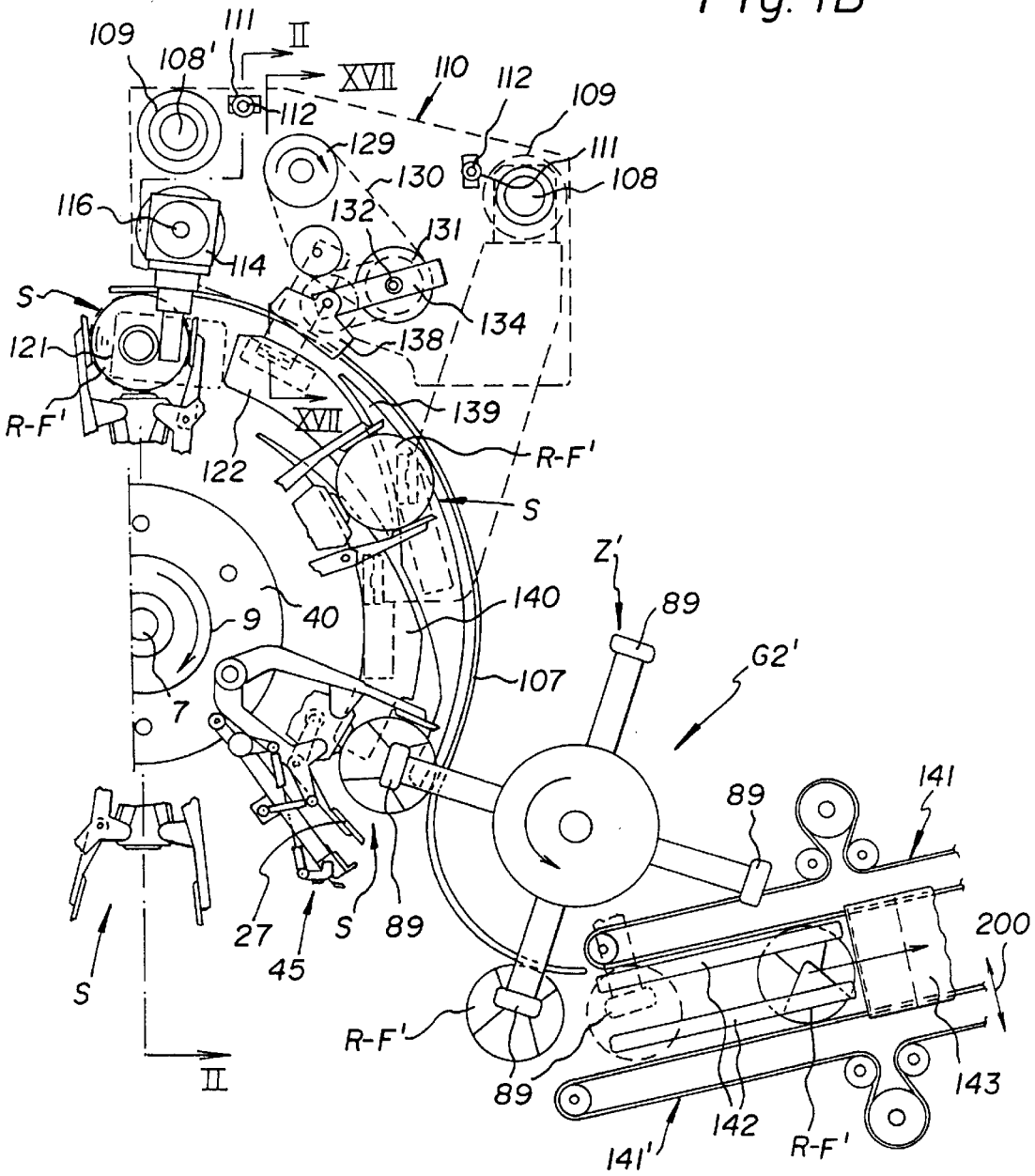

With reference to FIG. 1 the means which supply the packaging sheet to the main carousel G1 are now described.

The packaging film F, unwound from a reel, not shown, is driven by a first pair of parallel and motor-driven rollers 59 at a speed proportional to the diameter of the rolls to be packaged and to the speed of rotation of the main carousel G1. The film then passes through a group formed by a rotating cutter 60 and by a fixed counter-cutter 60' which cyclically form on the film a transverse incision or weakening line. The film which leaves the group 60, 60', passes through the motor-driven belts 61 arranged above one another substantially at the same peripheral speed as the pulling rollers 59 and characterized by having two successive sections 61' and 61", the first of which holds the film firmly, while the latter retains the film with a slight amount of free travel, but always in conditions such as to guide and advance the film itself. Between these two sections of conveying belt there is a middle section 61'" where the film rests only on the upper belts. The film which leaves the conveying belts 61 is gripped along the longitudinal edges by pairs of belts 62 which are arranged above one another and are also connected to the kinematic chain of the machine by means of a special servo-control system and are oriented in a substantial tangential condition with respect to the main carousel G1, in accordance with the direction of rotation of this carousel, and which travel initially at the same speed as that of the upstream belts 61. When the gripper 45 of the carousel G1 passes in the open condition opposite the belts 62, these belts increase in synchronism their feeding speed, so as to cause tearing of the film along the weakening line formed by the means 60,60', which has travelled beyond the first section 61' of the belts 61, so that the pulling action is not hindered and the packaging sheet F' resulting therefrom is able to travel freely between the last section 61" of the said belts 61. One of the pairs of belts 62 is longer than the other one, as indicated by 62', and arranged in a substantially tangential condition with respect to the path followed by the grippers 45, and these same belts 62' are perforated and co-operate with suction chambers 63 such that the packaging sheet remains attached to the same belts 62' owing to the suction effect. The frame which carries the pair of belts 62', finally, is characterized by the fact that it is connected to servo-control systems, schematically indicated by the arrows 64, which in synchronism are able to cause oscillation of the said pair of belts about the initial axis 65, so as to move them temporarily away from the carousel G1, in order to prevent interference thereof with the active part 55' of the folding devices 55. When an open gripper 45, of a seat S of the carousel G1, passes in front of the pair of belts 62', the same belts, which as already mentioned accelerate their feeding speed, insert between the jaws of the said gripper the front side of the packaging sheet, after which the same gripper is closed and the said belts 62' are moved away so as not to interfere with the folding device 55 which follows. The packaging sheet F' is positioned above the seat S and remains outside the latter also owing to the effect of the centrifugal force which it derives from rotation on the carousel G1.

With reference to FIGS. 1, 11, 12 and 13 the first auxiliary carousel G2 which supplies the rolls R into the seats S of the main carousel G1 is now described.

From FIG. 1 it can be seen that the rolls R, supplied for example from the production line, are oriented by suitable means with their axis parallel to the direction of travel, are arranged in a single file and by a bladed conveyor 66 are separated from one another and supplied between a pair of parallel and horizontal conveyors 67 abutting at a suitable distance from the carousel G1 and motor-driven at the same speed and such as to be able to provide a roll R for each seat S of the same carousel G1 which passes in front of these conveyors. The rolls are arranged parallel to the axis of the carousel G2 and are centered with the seats S of the said carousel. Upon variation in the size of the rolls R, servo control systems, schematically indicated by the arrows 68, allow adjustment of the distance of the conveyor 66 from the fixed guide means 66' located above and modification of the distance of the bottom conveyor from the upper conveyor of the group of synchronized conveyors 67. The rolls supplied in synchronism by the pair of conveyors 67 are removed by the grippers of the first auxiliary carousel G2 and inserted into the seats S of the carousel G1 which cyclically pass in front of the carousel G2. From FIG. 12 it can be seen that the carousel G2 comprises a bush 69 which is fixed to the wall 1' of the casing 1 and parallel to the axis of the carousel G2 and which, by means of bearings 70, rotatably supports a hollow shaft 71 which, on the end section projecting into the same casing 1, carries keyed on it the toothed pulley 72 connected to the kinematic chain of the machine (see below). The hollow shaft 71 has mounted longitudinally inside it a fixed and composite structure 73 which at one end is supported by the same shaft 71 via bearings 74 and which at the other end is supported via bearings 75 by a disc with hub 76 fixed to an arched support arm 77 connected to the wall 1' of the casing 1, in order to limit the vibrations of the carousel G2 since it is arranged projecting considerably with respect to the base casing. The internal structure 73 projects with one of its ends inside the casing 1 where it is attached to a fixed fastening element 78. The part of the structure 73 inside the hollow shaft 71 has, mounted on it, in a symmetrical position two rectilinear slide-guiding groups 79,79' which are aligned with one another and parallel to the axis of the carousel G2, and the movable part of these groups has, fixed to it, the body of annular cams 80,80' which have a suitable profile and are provided with respective windows 81 for allowing the structure 73 and the slide-guiding groups 79,79' to pass through (FIG. 13). Nut screws 82,82' are fixed onto the body of these cams (FIG. 12), said nut screws co-operating with similar and opposite threads 83',83", namely a right-hand one and left-hand one, of a screw 83 which is parallel to the shaft 71 and which passes rotatably with bearings 84 through the fastened ends of the fixed structure 73 and which projects into the casing 1 where it carries, keyed onto it, a pinion 85 connected to the above-mentioned adjusting means. By rotating the screw 83 in either direction, the distance between the cams 80,80' is adjusted in a self-centring manner and the grippers of the carousel G2 are adapted to the varying size of the rolls to be packaged.

Figure 12:
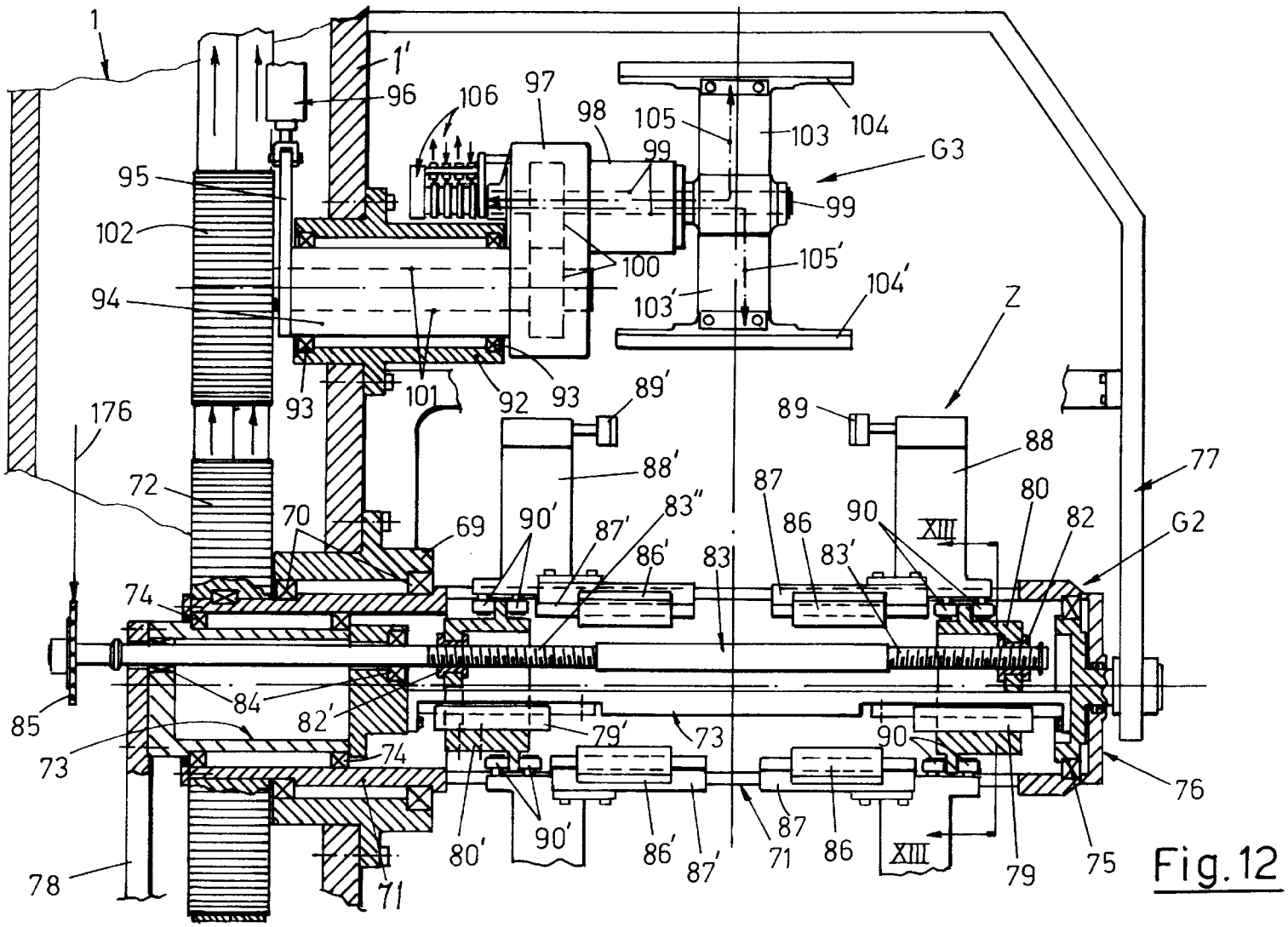
FIG. 12 shows details of the machine relating to the first auxiliary carousel supplying the rolls to the main carousel and relating to the group for heat-sealing the transverse edges of the sheet for wrapping the roll, shown along the cross-sectional line XII—XII of FIG. 1.
Figure 13:
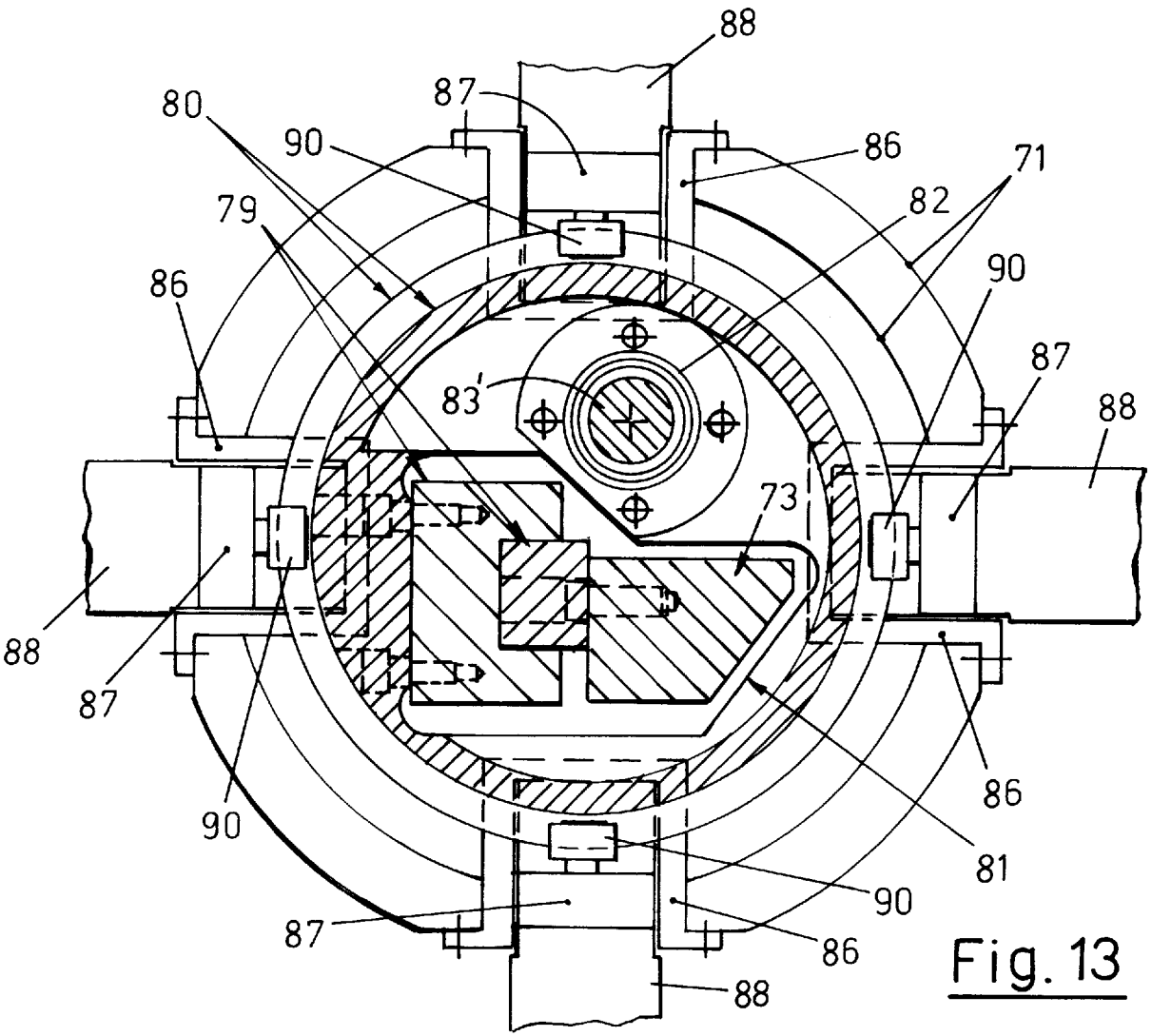
FIG. 13 shows details of the first auxiliary carousel partly sectioned transversely along the line XIII—XIII of FIG. 12.
Figure 14:
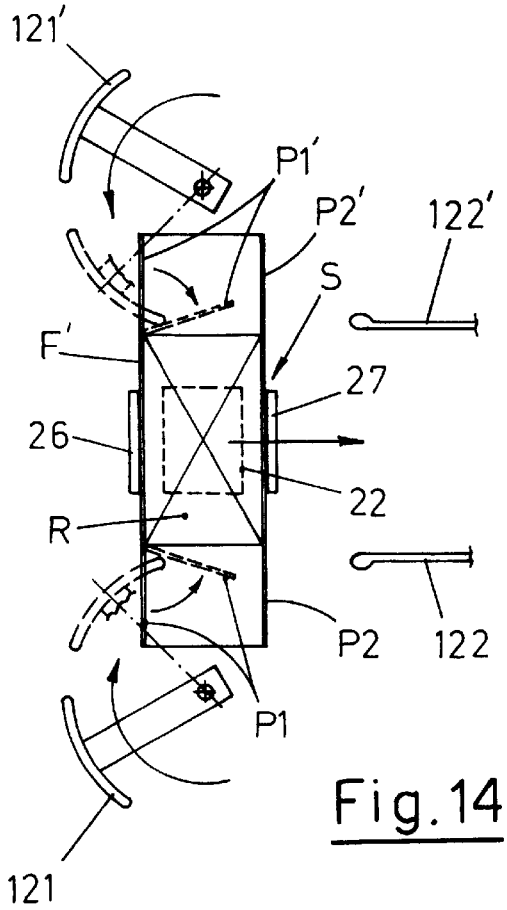
FIGS. 14 and 15 are diagrammatic top plan views of the first dynamic folding devices of FIG. 2, shown during successive steps of their working cycle.
Figure 15:
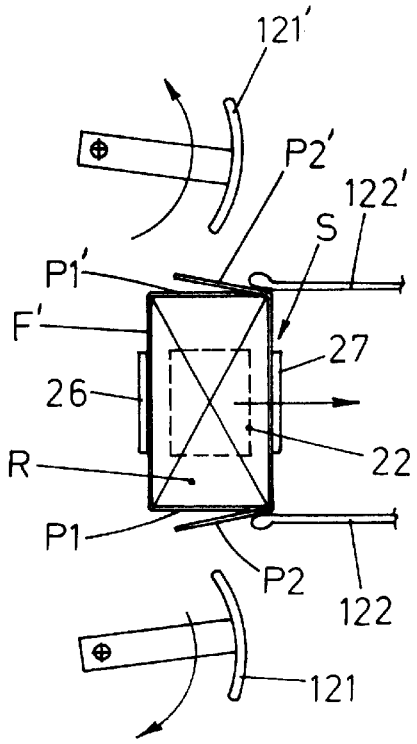
Figure 16:
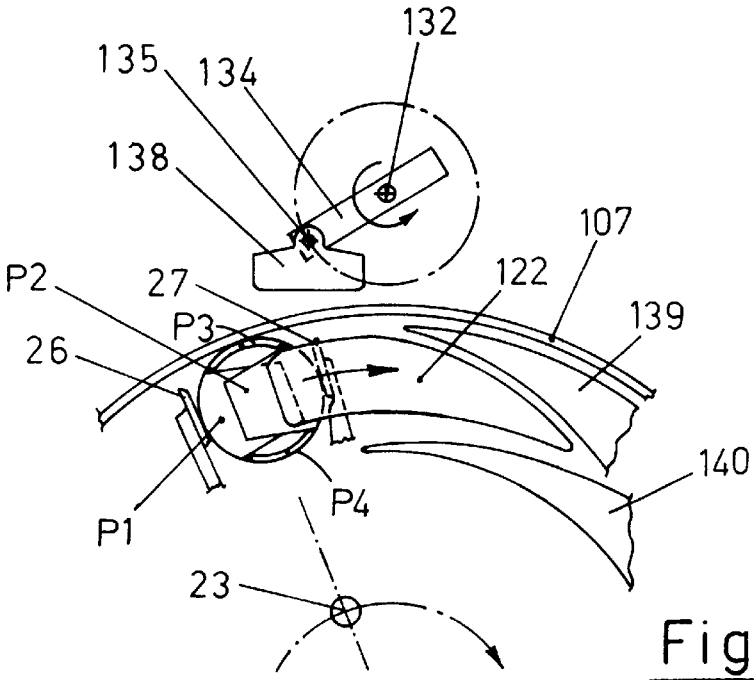
FIG. 16 shows a side view, on a larger scale, of the first fixed folding devices and the second dynamic folding devices which act on the ends of the sheet for packaging the roll.

Still with reference to FIGS. 12 and 13 it can be seen that the hollow shaft 71 of the carousel G2 has longitudinal openings, which are for example four in number and angularly equidistant with respect to one other and that each opening has fixed inside it, with a symmetrical arrangement, two straight guides 86,86' which are aligned with one other and parallel to the axis of the carousel and on which slides 87,87' travel with precision. These slides have fixed to them the radial arms 88,88' having at their ends the opposing and mutually aligned pads 89,89', at least one of which is suitably spring-loaded and this set of means forms the grippers Z of the auxiliary carousel G2. The moving elements associated with the slides 87,87' carry respective pairs of rollers 90,90' which follow the annular profile of the abovementioned cams 80,80'. During rotation of the hollow shaft 71, the grippers Z of the carousel G2, together with the rollers 90,90', derive from the cams 80,80' the necessary opening and closing movement.

From FIG. 1 it can be seen that the carousel G2 rotates in an anti-clockwise direction and with one of its grippers Z open it is aligned in synchronism with the ends of the roll R supplied by the pair of conveyors 67, after which the same gripper Z closes so as to grip the roll itself by the ends, subjecting it to a light axial load which does not deform the roll itself since it is reinforced axially by the presence of the cardboard core.

The speed of rotation of the carousel G2 is such that the roll cyclically gripped by a gripper of the carousel itself is then inserted into the seat S of the main carousel G1 without rubbing against the jaw 26 and without touching the jaw 27 which, as already mentioned, during this step is suitably moved away from the normal operating position, in order to avoid the aforementioned interference. The roll which is inserted into the seat S of the carousel G1, until it makes substantial contact with the cushion 22, pushes into the same seat the packaging sheet F' which is held at the front by the gripper 45, such that the sheet itself partially wraps the roll, with the rear edge also remaining projecting from the seat. In synchronism, while the gripper Z of the carousel G2 which supplied a roll is opened, the jaw 27 of the occupied seat S returns into the operative position and holds the roll with the sheet F' in the same seat. From FIG. 1 it can also be seen that, during the step of opening of the gripper Z and closing of the jaw 27, the roll R is held in the seat S and/or is correctly inserted into the latter, by co-operation with curved guiding means 90 fixed to the base structure of the machine.

With reference to FIGS. 1 and 4 the means which fold and overlap the rear edge and the front edge of the packaging sheet F'. in order to prepare them for sealing, are now described.

Before the seat S of the carousel G1 abandons the physical guiding means 190, the rear folding device 55 is activated so that, with its active part 55', it is positioned above the roll, as indicated by the broken lines in FIG. 4, and folds onto the roll itself the rear edge of the packaging sheet F'. In a synchronized sequence the gripper 45 opens and the front edge of the wrapping sheet is folded onto the rear edge by suitable means which generate, for example, an air stream suitable for this purpose, for example by means of a nozzle bar 91 fixed to the base of the machine and located downstream of the guiding means 190 and designed to deliver jets of air directed against the said front edge of the sheet F' so as to fold it over and keep it flat on the roll. It is understood that folding of the front edge may be performed and/or aided also using means different from those indicated, for example using a suction air stream generated by means associated with the end part of the guiding means 190 and/or by means, also not shown, which act on any end portions of the edge of the sheet not affected by the gripper 45. In synchronism with folding of the front edge of the packaging sheet, the rear folding device 55 moves away from the seat S and returns into the rest position so as to leave the edges free for heat-sealing.

With reference to FIGS. 1 and 12 the sealing carousel G3 which seals the front and rear edges of the packaging sheet is now described.

From FIG. 12 it can be seen that a bush 92 parallel to the axis of the aforementioned carousels is fixed onto the wall 1' of the casing 1 and inside this bush there is rotatably mounted with bearings 93 a hollow shaft 94 which, with one of its ends, projects inside the casing 1 where it carries, fixed, a lever arm 95 connected to a pneumatic and composite actuator 96 which is in turn anchored to the base of the machine. On the end outside the casing 1, the hollow shaft 94 carries integrally a box-shaped body 97 with which the end of a hollow shaft 98 parallel to the shaft 94 is integral and which rotatably supports the spindle 99 of the sealing carousel G3 which by means of a gear 100 located inside the said box 97 is connected to a shaft 101 which is rotatably mounted in the hollow shaft 94 and which enters into the casing 1 and carries keyed onto to its end the toothed pulley 102 connected to the kinematic chain of the machine (see below). The sealing carousel G3 is for example composed of a pair of arms 103,103' which are fixed radially onto the outside end of the spindle 99 and which are angularly equidistant from one another and which support the heat-sealing bars 104,104' parallel and equidistant with respect to the spindle 99. The electrical and, if necessary, also the pneumatic connections schematically indicated by the arrows 105,105', necessary for operation of the sealing bars, pass through the arms 103,103', pass through the spindle 99 and emerge from the end of the latter which projects at the rear of the box 97, for connection to collectors and to rotating distributors schematically indicated in their entirety by 106.

The operating mode of the sealing carousel G3 thus conceived is as follows. The carousel G3 of FIG. 1, rotates in an anti-clockwise direction and with an orbital speed of the active part of the bars 104,104' the same as that of the overlapped edges of the packaging sheet to be sealed together in the seat S of the carousel G1. At the start of the operating cycle the pneumatic group 96 is such as to keep the carousel G3 in the position closest to the carousel G2 so that one bar 104 of the same carousel manages to co-operate with the edges of the sheet to be sealed as soon as the edges have been arranged on top of one another and have travelled past the said folding means 91. In a synchronized sequence the group 96 adapts its thrusting force so as to allow the carousel G3 to oscillate about the spindle 101 such that the active sealing bar 104 or 104' remains in contact with the edges to be sealed over a sufficient section of their orbital path, after which the same means 96 are positioned so as to keep the carousel G3 in the position furthest away from the carousel G2 and then in the position close to it and finally in the position for leaving it. The pneumatic group 96 is composed, for example, of two cylinder and piston groups which have a different stroke, are aligned with one another, fixed together on the bottom of the body and hinged with the opposing stems, on the one hand, to the lever arm 95 and, on the other hand, to the base of the machine.

With reference to FIGS. 1, 2 and 14 to 21, a description is now given of the folding devices which are partly dynamic and partly static and which close the ends of the tubular and transversely sealed sheet which surrounds the roll.

From FIGS. 1 and 2 it can be seen that, downstream of the sealing carousel G3, the roll R partially packaged by the partially tubular and transversely sealed sheet F' is held correctly in the seats of the main carousel G1 also by guiding means 107 which are fixed to the base of the machine and which preferably accompany the roll itself also during the stage of unloading from the carousel G1 (see below).

The wall 1' of the casing 1 has fixed to it in cantilever fashion and perpendicularly at least one pair of guiding bars 108,108' on which there slide by means of suitable bushes 109,109' a pair of plates or shoulders 110, 110' which are positioned edgeways and are parallel to the wall 1' and equidistant from the sides of the seats S of the carousel G1 and which are provided, parallel to the bushes, with nut screws 111,111' which co-operate with oppositely threaded sections 112',112" of a pair of screws 112 which with one of their ends pass through the wall 1' of the base and which by means of a suitable bracket with bearings 113 are mounted rotatably on this wall and are kinematically connected together and to the mechanisms which adjust the machine according to the variation in size of the rolls to be packaged. By operating these screws in either direction, the distance of the shoulders 110,110' and of the folding devices mounted on them from the sides of the seats of the carousel G1 is varied in a self-centering manner in order to adapt the folding devices for the handling of rolls of different sizes.

From FIGS. 1 and 2 it can be seen that on the outer sides of the shoulders 110,110' there are fixed the bodies of two angular bevel-gear transmission systems 114,114' which are the same and mutually aligned with the input shaft which is axially hollow and is provided with longitudinal groove which co-operates with the splines 115,115' of a shaft 116 which is parallel to the guide rods 108 and which passes through the input shafts of the transmission systems and which by means of a safety coupling 117 is connected to a toothed pulley 118 supported rotatably via the bracket 119 by the base wall 1' and which is connected to several components of the kinematic chain of the machine (see below). The output shafts of the transmission systems 114, 114' are oriented in a substantially radial direction with respect to the carousel G1, towards the center of this carousel, and have keyed on them short perpendicular arms 120,120' with end segments 121,121' having their center of curvature substantially on the axis of the output shafts. From FIG. 14 it can be seen that when a seat of the carousel G1 passes in front of the dynamic folding devices in question, the arms 120,120' are oriented in the direction from where the seats arrive and are such as not to interfere with the ends of the tubular packaging sheet. In synchronism, the segments 121,121' of the said arms co-operate with the rear middle portion of the ends of the tubular sheet and fold this portion of sheet onto the ends of the roll, as indicated by P1,P1'. Before the folds P1,P1' are abandoned by the segments 121,121', the corresponding front middle portions of the ends of the tubular sheet F' co-operate with fixed folding devices 122,122' which fold these portions P2,P2' onto the aforementioned portions P1–P1' and which then hold these folded portions correctly on top of each other for a required section of the path of the seats S of the carousel G1 (see below).

Immediately following the initial part of the fixed folding devices 122,122' there are provided second dynamic folding devices which are now described with reference to FIGS. 1 and 17 to 20. From FIGS. 1 and 17 it can be seen that on the outer side of the shoulders 110,110' there are rotatably mounted, by means of special brackets with bearings 123, 123', bushes 124,124' which are aligned with one another and provided internally with respective longitudinal cavities for co-operation with the splines 125,125' of a shaft 126 which passes through these bushes, which passes through the wall 1' of the base casing 1 of the machine, which is rotatably supported by this wall by means of a bracket with bearings 127 and which carries, keyed onto its end, a toothed pulley 128 connected to the kinematic chain of the machine (see below). On the ends of the bushes 124,124' projecting from the outer sides of the shoulders 110,110' there are keyed toothed pulleys with the same diameter 129,129' connected by means of toothed belts 130,130' to corresponding toothed pulleys 131,131' of the same diameter which are in turn keyed onto the ends of shafts 132,132' which are aligned axially and are supported rotatably with bearings by the body of crown gears 133,133' flanged onto the inner side of the shoulders 110,110'. On the ends of the shafts 132,132' which project from the inner sides of the said shoulders 110,110' there are keyed respective arms 134,134' which are identical, parallel and oriented in the same direction and which rotatably support on the free end, by means of suitable brackets with bearings, hubs 135,135' which, on the end directed towards the outside, have keyed onto them respective toothed pulleys of the same diameter 136,136' connected by means of toothed belts 137,137' to the said fixed crown gears 133,133'. Blades 138,138' are keyed onto the end of the hubs 135,135' directed towards the carousel G1, the blades being identical, parallel to one another and oriented in the same sense and substantially in the direction of the axis of the main carousel G1. From what has been said it is obvious how rotation of the shaft 126 produces a corresponding movement of revolution of blades 138,138' about the axis of this shaft and how these blades always remain oriented in the same direction.

From FIGS. 1, 16, 18 and 19 it can be seen that, immediately after the folded portions P1,P1' and P2,P2' of the ends of the tubular packaging sheet have been retained by the fixed holding devices 122,122', the upper middle portions P3,P3' of the same ends of the sheet are acted on by the blades 138,138' which fold these portions P3,P3' onto the fixed folding devices. From FIGS. 1 and 20 it can be seen that, before the folded portions P3,P3' are released by the blades 138,138', the same portions are acted on in synchronism by the front tapered end of fixed folding devices 139,139' which keep these portions folded, allowing the blades to move away and repeat the cycle to be performed by them. From FIGS. 1 and 20 it is apparent how the first fixed folding devices 122,122' are characterized by a progressively decreasing width and how instead the second fixed folding devices 139–139' are characterized by a progressively increasing width, such that while the folded portions P3,P3' are gradually released by the first fixed folding devices, the same portions are gradually engaged by the said second fixed folding devices. From FIGS. 1, 20 and 21 it can be seen that, while the folded portions P3,P3' of the packaging sheet are acted on by the said second fixed folding devices, the opposite and bottom portions P4,P4' of the same packaging sheet are acted on by third fixed folding devices 140,140' which fold these portions onto the said second folding devices, with a progressively increasing action produced by the progressively increasing width of the latter fixed folding devices. From FIG. 21 it can be seen that, in their end part, the opposite edges of said second and third fixed folding devices have a tapered form which leaves free central portions of the packaged ends of the rolls which are wide enough to be gripped by successive means which will perform unloading of the packaged rolls from the main carousel G1.

Figure 21:
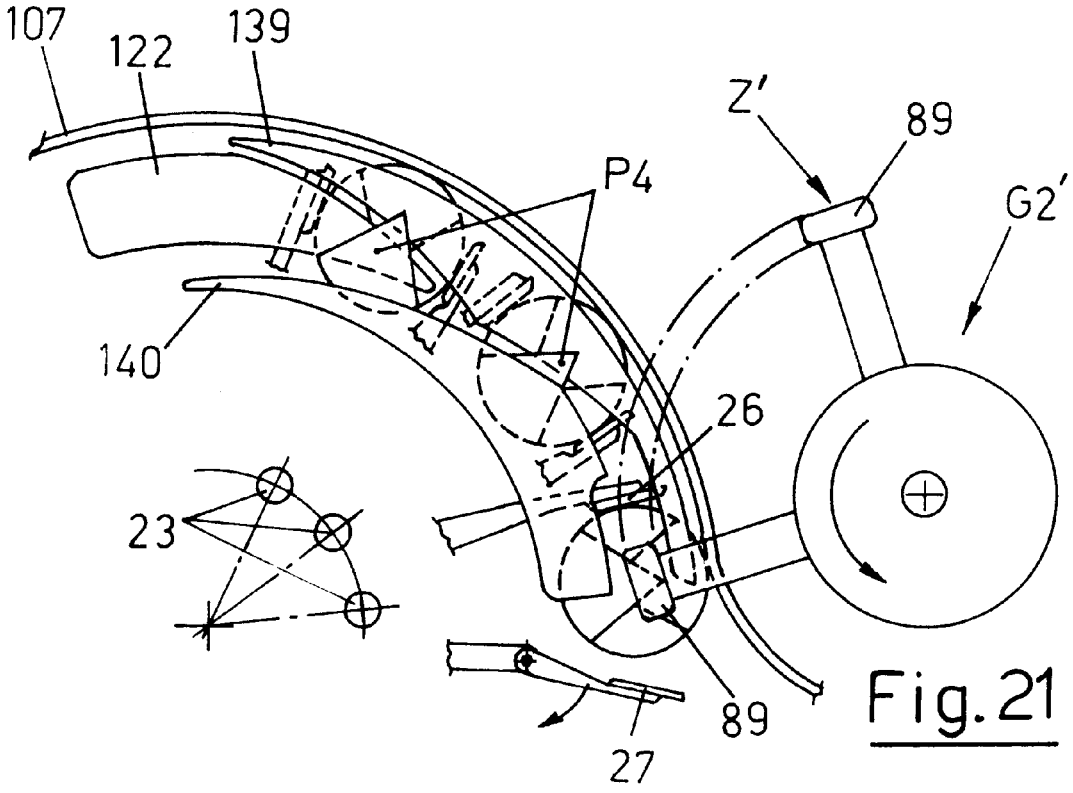
FIG. 21 shows laterally the fixed folding devices which complete closure of the ends of the roll packaging and partially illustrates co-operation with these folding devices of the grippers of the second auxiliary carousel for unloading the packaged rolls from the seats of the main carousel.
Figure 22:
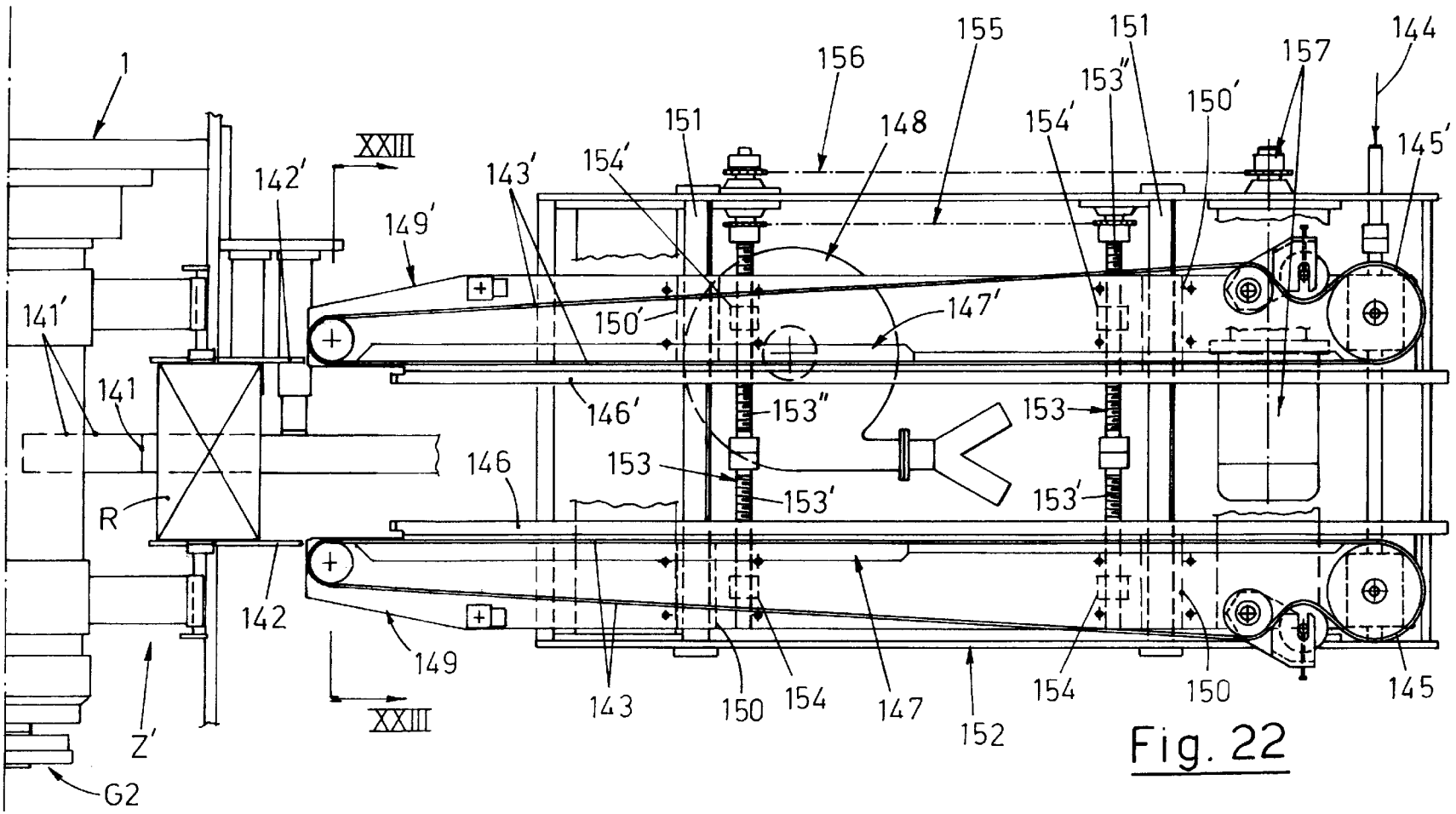
FIG. 22 shows a plan view of the means located downstream of the second auxiliary carousel, for collecting the packaged rolls unloaded from this carousel and for sealing the overlapped end edges of the packaging of each roll.

With reference to FIGS. 1, 21 and 22 the means which perform unloading of the packaged rolls from the main carousel G1 are now described.

These means comprise a carousel G2' which has an axis parallel to that of the carousel G1 and which rotates in an anti-clockwise direction and which is similar to the carousel G2 already considered for inserting the rolls into the seats S of carousel. The pads 89,89' of the grippers Z' of this carousel G2', during their self-centring closing movement, grip by their central and free end portions the packaged rolls housed in the seats S, unload these rolls from the seats, while in synchronism the jaws 27 move apart so as to widen the seats and facilitate the unloading operation in progress. The grippers of the carousel G2' will transfer the rolls to following conveying means and means for sealing the end folds P1,P4;P1',P4' described further below.

It is understood that the scope of the invention also includes the constructional variant whereby the grippers of the extraction carousel G2' are also able to perform heat-sealing of the overlapped end edges of the packaging, or only the heating necessary for heat-sealing, while cooling of the sealed parts is performed by following means for gripping and removing the packaged rolls.

Figure 23:
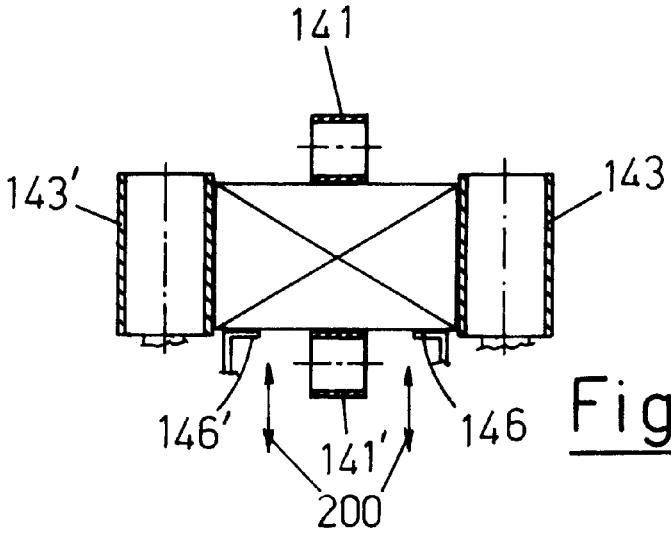
FIG. 23 shows details of the means according to FIG. 22, partially sectioned transversely along the line XXIII—XXIII.

With reference to FIGS. 1, 22 and 23 the means for sealing the folded and overlapped end parts of the roll packages are now described.

From these figures it can be seen that, when the packaged roll is still held by the grippers Z' of the unloading carousel G2', the roll itself is inserted by this carousel between a pair of parallel belt-type discharge conveyors 141,141' which are arranged above one another and motor-driven by the kinematic chain of the machine (see below) so as to advance with the internal branches at the same orbital speed as the rolls which are still held by the carousel G2', so as to take over gripping and conveying of the rolls. At the same time, the packaged roll which has been inserted between the discharge conveyors, co-operates, with its free end portions, with fixed and adjustable guides 142,142 so that the roll itself, held by these downstream means, may be released by the grippers of the carousel G2' which open up with a self-centering movement, as already described for the carousel G2.

It is understood that motor-driven conveyor belts, synchronized with the conveyors 141,141', may be provided in place of the aforementioned guides 142,142', so as to avoid upsetting even minimally the ends of the roll packages.

In a synchronized sequence, the ends of the packaged rolls are released by the guides 142,142' and come into contact with the internal sections of a pair of vertical-axis belt conveyors 143,143' which are motor-driven on the end pulleys 145,145' by suitable means schematically indicated by the arrow 144 and advance with the said internal sections at the same speed and in the direction useful for conveying away the packaged rolls. When the rolls start to co-operate with the conveyors 143,143', the ends of the rolls themselves rest and travel on straight guides 146,146' which are fixed onto the same frame as the conveyors. The conveyors 143,143' are constructed with belts made of teflon or equivalent material and their internal sections are heated by suitable means 147,147' which are powered electrically and suitably temperature-regulated and which supply the heat necessary for heat-sealing the overlapped end portions P1–P4 and P1'–P4' of the packaging of the rolls. Downstream of the heating means there are provided means 148 which emit streams of cooling air against the ends of the packaging, said streams fixing the sealed parts of the packaging itself such that the packaged rolls may be freely unloaded by the means in question, for example towards other collecting and packaging means, not shown.

From FIG. 22 it can be seen that the frames 149,149' of the conveyors 143–143' are slidably mounted with associated bushes 150,150' on a pair of transverse and horizontal guiding rods 151 supported at the ends by the sides of a base frame 152. These sides rotatably support the ends of a pair of screws 153 each provided with oppositely threaded sections 153,153" which cooperate with nut screws 154,154' integral with the said frames 149,149'. The screws are interconnected by a positive transmission system 155 and one of these screws is connected via a further fixed transmission system 156 to a drive group 157 for electronically controlling the speed and timing, which can be remotely operated by means of the machine control console. By rotating in either direction the screws 153, the sealing conveyors 143,143' modify in a self-centring manner their mutual distance for adaptation to the different size of the rolls to be packaged.

In FIGS. 1 and 23, means schematically indicated by the arrow 200 are provided for adjusting the heightwise position of the conveyor 141' and guides 146,146' according to the variation in size of the rolls to be packaged.

Figure 24:
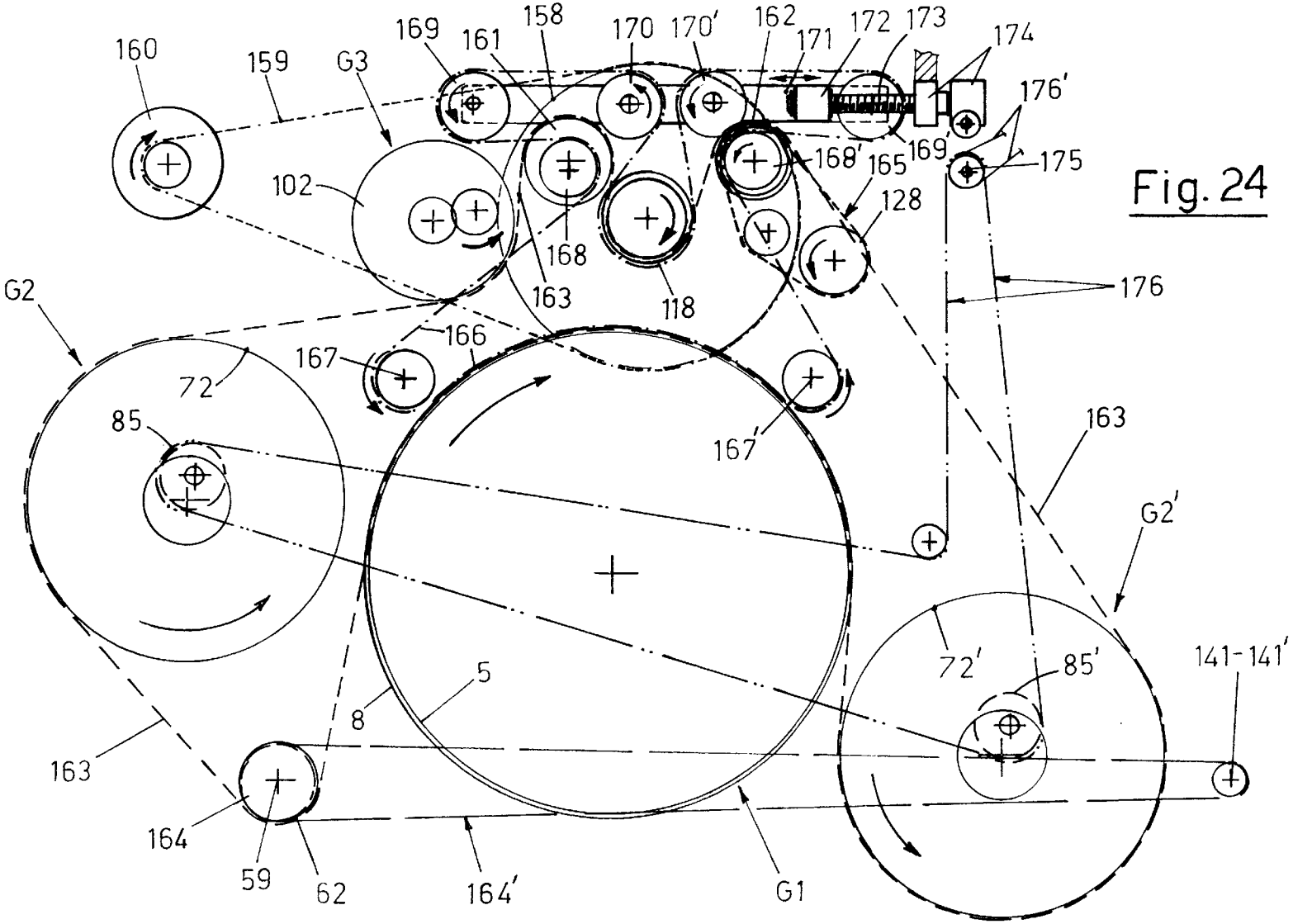
FIG. 24 shows the kinematic chain which moves the various operating stations of the machine and which allows the adjustments for adapting the machine for packaging rolls of varying size.

With reference to FIG. 24 the kinematic chain which operates in synchronism the various machine components and allows adjustments according to the variation in the size of the rolls is now described.

Figure 17:
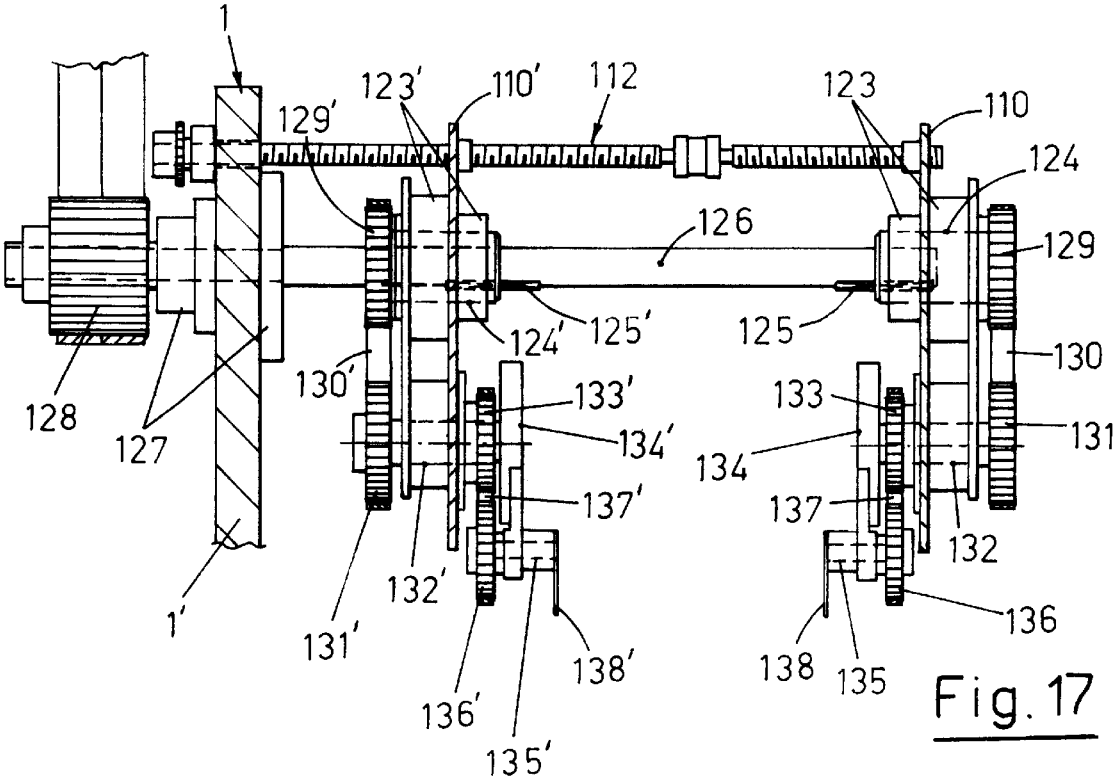
FIG. 17 shows details relating to the second dynamic folding devices according to FIG. 16, shown partially along the cross-sectional line XVII—XVII of FIG. 1.
Figure 18:
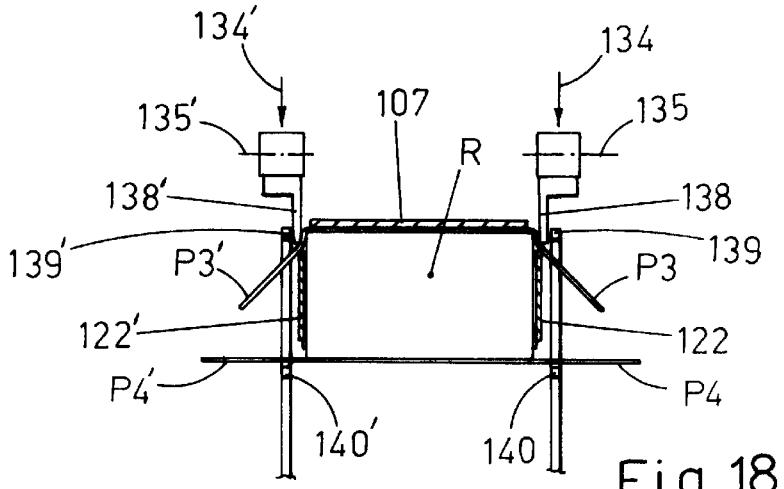
FIG. 18 shows a front view of action of the second dynamic folding means on the ends of the sheet for packaging the roll.
Figure 19:
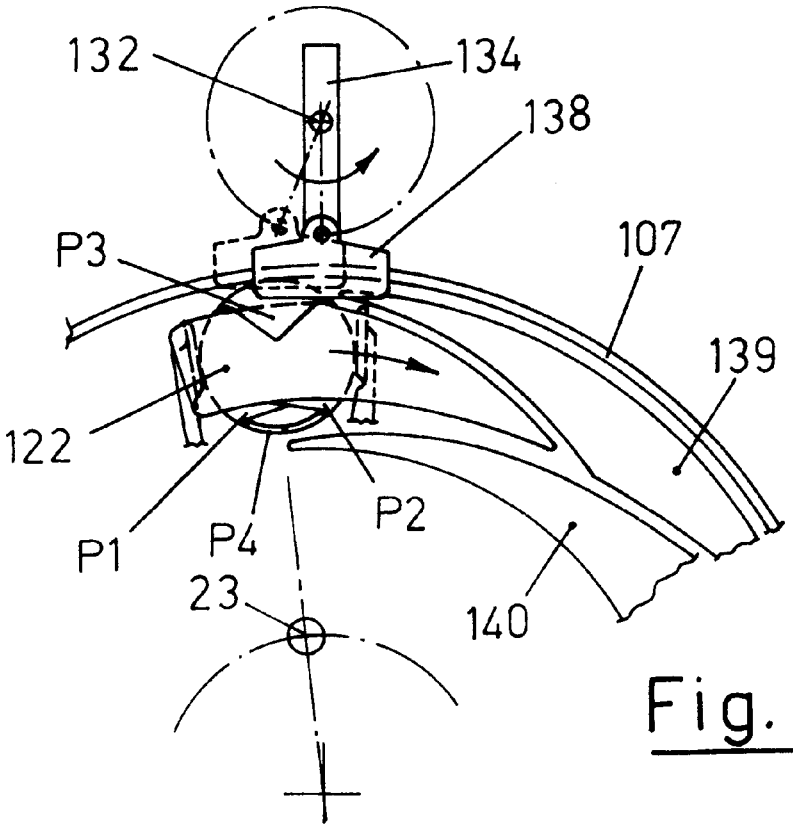
FIGS. 19 and 20 are side views of the said second dynamic folding devices, shown during successive steps of their working cycle.
Figure 20:
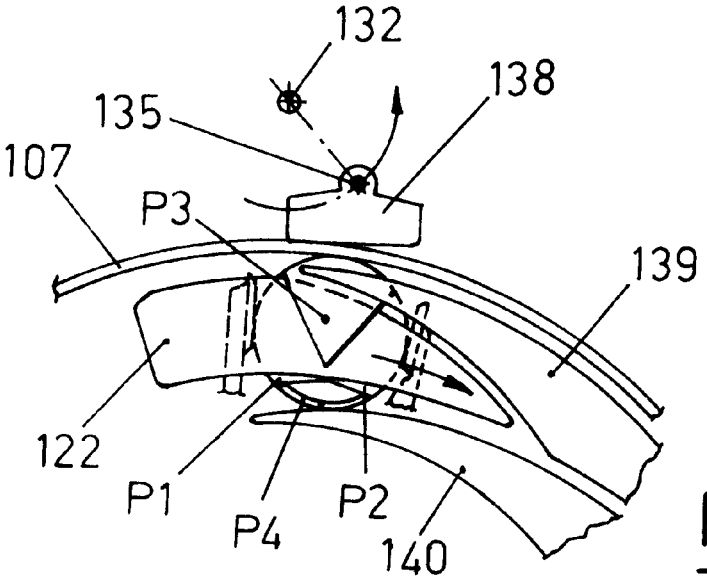

With reference also to FIG. 2 it can be seen that there is keyed on the same shaft on which the toothed pulley 118 for operating the first dynamic folding devices with the segments 121,121' is keyed, a toothed pulley 158 which by means of a toothed belt 159 is connected to the motor 160 for centralized operation of the machine. Laterally and in alignment with the toothed pulley 118 there are provided, in a parallel arrangement, two toothed pulleys 161 and 162 on which an internal and external toothed belt 163 is driven, said toothed belt acting on the said toothed pulley 118, the pulley 102 of the sealing carousel G3, the toothed pulley 72 of the first auxiliary carousel G2, then the toothed pulley 164 which transmits the movement to the apparatus supplying the packaging material to the main carousel which then operates the toothed pulley 5 of the same carousel G1 and which operates, finally, the toothed pulley 72' of the unloading carousel G2'. The spindle of the pulley 164 transmits, by means of a positive transmission 164', the movement to the group for sealing the ends of the packaging, described with reference to FIGS. 22 and 23. The spindle of the toothed pulley 162, by means of the positive transmission 165, operates the toothed pulley 128 which transmits the movement to the second dynamic folding devices with the blades 138,138' (FIG. 17).

The toothed pulley 8 (FIG. 2), which allows adjustment of the width of the seats of the main carousel G1, is acted on, along an upper section of its circumference, by an externally toothed belt 166 driven on a first idle pulley group 167, 167', then on a second idle pulley group 168, 168' and then on a third idle pulley group 170,170', all supported by the base of the machine, and finally driven on pulleys 169,169' supported by a horizontal slide 171 and then on the toothed pulley 118 of FIG. 2 which has a width suitable for this purpose. The slide 171 is supported by guiding means, not shown, fixed to the base of the machine and is provided with a nut screw 172 which co-operates with a screw 173 connected to a reducer or to a motor reducer 174 fixed to the base of the machine. By operating the latter means it is possible to cause horizontal displacement of the slide 171, with consequent horizontal displacement of the idle pulleys 169,169' which modify in a reverse manner the length of the upper toothed belt arms 166 driven on these pulleys and which therefore modify the angular position of the toothed pulley 8 with respect to the toothed pulley 118 which is assumed to be at a standstill.

From FIG. 24 it can be seen that, opposite the drive means 174, there is arranged another drive means 175 which, if necessary, is connected to the first means with suitable transmission ratios and from which there departs a first positive transmission system 176 which actuates the pinions of 85,85' of the endless screws for adjusting the auxiliary carousels G2,G2' according to FIG. 12, and, if necessary, a second positive transmission 176' for operation of the endless screws adjusting the shoulders 110,110' with the devices for folding the ends of the packaging.

It is understood that the constructional details relating to the electrical circuits and the fluid pressure circuits, as well as the various sequential, consent and security devices have been omitted from the description, in that they are not necessary for understanding of the invention and because they may be easily deduced and realized by persons skilled in the art.

Finally it is understood that the description relates to a preferred embodiment of the invention to which numerous variations and modifications, in particular of a constructional nature, may be made, said variations and modifications referring for example to the fact that closing of the ends of packaging of the rolls may also be performed with folding over of the said packaging into the axial cavity of the rolls themselves. Closing of the ends of the packaging may be performed with the folding devices described, or with dynamic folding devices which perform a kind of puckered closure of the said ends of the packaging. The folding over of the packaging into the ends of the cavity of the rolls may be performed by suitable means when the rolls are still in the main carousel G1 or else may be performed by means associated with the grippers of the extraction carousel G2' or by suitable means operating upstream of the conveyors 143,143'.

A further variation may refer to the use of a packaging material other than heat-sealable film, for example paper treated, if necessary, with glues or thermal glues. In this case the use of the sealing carousel G3 and, if necessary, the use also of the bars 147,147' for end sealing may be not be envisaged, with the consequent elimination of one or both the operations which are performed by these parts of the machine.

We claim:

1. An automatic machine of the carousel type for individual packaging of rolls of paper of varying size comprising:

a main carousel having a horizontal axis and including angularly equidistant seats opening outwardly and having dimensions adjustable according to size of the rolls to be packaged, each of said seats being suitable for containing a roll arranged with an axis thereof parallel to the axis of the main carousel, each of said seats including gripper means at a front end for holding a front transverse edge of a packaging sheet and having at a rear end a folding device normally in a retracted rest position, said folding device, upon actuation, closing the seat on a side of a circumference of the main carousel so as to fold onto a roll a rear transverse edge of the sheet still held at the front end by the gripper means;

first adjustable means supplying in synchronism, to the gripper means of each seat of the main carousel, a packaging sheet having dimensions suited to size of a roll to be packaged and arranged above the seat;

a first auxiliary carousel having an axis parallel to the axis of the main carousel located downstream of the sheet supplying means and including angularly equidistant grippers adjustable according to variation in size of rolls, each of said grippers gripping ends of a roll supplied by suitable supply means and oriented with the axis parallel to that of the main carousel, the first auxiliary carousel inserting a roll into each seat of the main carousel, while the roll is partially wrapped with the sheet which is held in the seat by the associated front gripper;

folding means which in synchronism with intervention of the folding device of each of the seats of the main carousel and in synchronism with opening of the front gripper of the seat, fold onto a roll a front transverse edge of the sheet, while in synchronism the folding device returns to the rest position so as to allow the front and the rear transverse edges of the sheet to be arranged on top of one another;

sealing means arranged downstream of the folding means and which in synchronism seal together the overlapped transverse front and rear edges of the packaging sheet;

second adjustable means for folding onto the ends of each roll, located in the seats of the main carousel, the sections of packaging sheet which project from the ends of the rolls;

a second auxiliary carousel having an axis parallel to that of the first auxiliary carousel and extracting in synchronism packaged rolls from the main carousel, holding the packaged rolls by ends thereof so as to keep the ends of the packaged rolls folded, the second auxiliary carousel being designed to transfer the packaged rolls to downstream conveying means;

said downstream conveying means sealing the folded ends of the packaging of the rolls conveying away the rolls towards packing means.

2. The machine according to claim 1 further comprising means for ensuring that the seats of the main carousel are adaptable to varying sizes of rolls to be packaged, such that said seats have self-adjustment of degree of opening and variation in centering depth, so that position of rolls remains unvaried towards an outside thereof and with respect to the gripper and the folding device associated with each seat and with respect to the sealing means, sealing the transverse edges of the packaging sheet.

3. The machine according to claim 1, wherein the means for supplying the packaging sheet to the main carousel and the means for folding the end edges of the tubular sheet for packaging the rolls, and the grippers of the first and the second auxiliary carousels and the downstream conveying means which seal the end edges of the packaging of the rolls, are adaptable for the handling of rolls of varying size via associated means for self-centering adjustment with respect to the ideal vertical center line of the main carousel.

4. The machine according to claim 1, wherein the various stations are mounted in cantilever fashion on a wall of a robust box-like base structure, which has arranged on an inside thereof a kinematic chain operating the stations in synchronism and housing means allowing adjustments for adapting the stations to packaging rolls of varying size.

5. The machine according to claim 1, wherein each of the seats of the main carousel comprises a bracket fixed radially on a spindle of the main carousel and carrying, hinged on a common fulcrum parallel to the spindle, a pair of radial levers having at ends thereof jaws defining a rear wall and a front wall of the seat, opposite parts of a circumference of the roll resting against the radial levers and on a cushion located between the jaws and supported by a slide of a slide-guiding group mounted on the bracket with a substantially radial arrangement with respect to the main carousel and the slide having, fixed thereto, a cross-piece parallel to the main carousel axis and having fixed on one end a vertical plate located on an ideal plane perpendicular to the main carousel axis and having straight tracks in a "V" arrangement diverging outwards and with a center-line axis perpendicular to the axis of the first auxiliary carousel, the tracks being engaged by end rollers of a pair of lugs integral with the levers in such a way that outwards displacement of the cushion results in a corresponding movement towards one another and self-centering of the jaws, so as to adapt the seats for containing small-size rolls, while displacement of the cushion towards the axis of the carousel results in the jaws moving away from each other with self-centering displacement, so as to adapt the seats for containing large-size rolls, an opposite end of the cross-piece being hinged on the end of a tie-rod having an opposite end hinged on a spoke integral with a plate keyed onto an end of a shaft passing axially and rotatably through the hollow spindle of the main carousel, the shaft and spindle projecting into the base casing wherein the spindle and the shaft have keyed on them respective toothed pulleys connected to a same source of movement, the spindle being directly connected and the shaft being connected via angular phase-displacement means.

6. The machine according to claim 5, wherein the lever carrying the front jaw of each of the seats of the main carousel is divided up into two sections interconnected by a hinged connection parallel to the spindle of the carousel, one of said two sections being a lever section having the jaw integral with the spindle which forms the hinged connection, the spindle including, on the end directed towards the base casing, a lever arm having a pair of end rollers following a profile of an annular cam fixed onto a disc flanged coaxially onto an external end of the hollow spindle of the main carousel, the profile of the cam being such that, during steps of insertion and unloading of a roll into and from one of the seats of the main carousel, the front jaw of each of the seats is moved away beforehand from the opposite jaw to increase width of the seat and avoid damaging interference of the seat with the roll.

7. The machine according to claim 5, wherein the gripper which holds the front edge of the packaging sheet on the seat of the main carousel has an opening parallel to the axis of the main carousel in a direction of the seat and includes a fixed lower jaw and a hinged and spring-loaded upper jaw, the gripper being mounted on an end of a lever having a substantially radial arrangement with respect to the main carousel, connected by means of a tie-rod to an extension lug of a bottom section of one of the radial levers with the front jaw of the seat mounted rotatably with a base thereof on a shaft supported in turn rotatably by the bracket supporting a fulcrum of the radial levers of the seat, the seat being parallel to the fulcrum and having on the end oriented towards the base casing a lever arm having end rollers following a profile of an annular cam fixed on the disc flanged onto the outer end of the hollow spindle of the main carousel, the shaft having fixed thereto a further lever arm causing, by means of a tie-rod, opening and closing of the gripper.

8. The machine according to claim 1, wherein the folding device mounted at the rear of each of the seats has substantially a form of a spatula as wide as the packaging sheet and fixed, with a tapered part inclined towards the center of the carousel, onto an end of a lever pivoted with a base thereof on a same fulcrum as the levers supporting the jaws defining the seat, the lever being provided on the side directed towards the base casing with a lever arm following, with a roller, a profile of an annular cam fixed coaxially onto a disc flanged onto the hollow spindle of the main carousel, the rest position of the folding device in question not changing with a variation in size of the rolls to be packaged and the folding device having a fixed working stroke.

9. The machine according to claim 1, wherein the means supplying the packaging sheet to the gripper of the seats of the main carousel comprises:

first means for longitudinally feeding a packaging film unwound from a reel and having a width greater than a length of a generatrix of rolls to be packaged, feeding speed of the first means being proportional to a diameter of the rolls to be packaged and to speed of the main carousel;

cyclical operation means forming on the moving film one of a transverse weakening, incision and perforation line;

second means and third successive means for longitudinally feeding film emerging from the incision means, which advance substantially at a same speed as the first feeding means and the third means exerting on the film essentially a guiding action, leaving the film free to react when subjected to a pulling action in synchronism by successive means causing tearing of the film along the transverse line formed by the cyclical operating means;

two pairs of belts arranged above and alongside one other and gripping at least along longitudinal edges the film leaving the third feeding means, travelling at a speed initially equal to that of said third means, the belts being oriented tangentially with respect to the main carousel and which, when the gripper of each seat of the carousel passes opposite them, increase speed in synchronism in order to cause tearing of the packaging sheet along the transverse line and insert the end of the sheet into the gripper which closes in synchronism, one of the two pairs of belts being longer than the other one of the two pairs, being oriented with an active branch in a direction of the main carousel, being of a suction type in order to hold the section of film produced by tearing, being pivoted on an initial axis and being connected to means so that, when the front edge of the sheet of film produced by tearing has been inserted between the jaws of the gripper of the seat of the main carousel and after the gripper has been closed, they move away this pair of belts from the carousel so as to avoid interference thereof with the folding device which follows, after which the pair of belts returns into the active position in order to repeat a next working cycle.

10. The machine according to claim 1 further comprising:

means comprising a blade conveyor for separating the rolls, oriented transversely with respect to a direction of forward movement, by a distance proportional to mutual distance between the seats of the main carousel and for arranging the rolls in synchronism and in alignment with these seats;

a pair of parallel conveyors arranged above one another and motor-driven so as to separate the rolls from the blades of the upstream conveyor and such as to feed the rolls tangentially with respect to the first auxiliary carousel, said first auxiliary carousel removing the rolls by ends thereof and inserting the rolls in synchronism into the seats of the main carousel.

11. The machine according to claim 1, wherein the first auxiliary carousel designed for insertion of the rolls into the seats of the main carousel comprises:

a hollow shaft parallel to the axis of the main carousel and supported rotatably and in cantilever fashion by a base casing, the hollow shaft, by suitable means, being made to rotate continuously and in a direction opposite to direction of rotation of the main carousel, the shaft including correct number of longitudinal openings angularly equidistant and having fixed therein a symmetrical arrangement of longitudinal guides having slides including arms which are fixed thereon, the arms being identical and located radially with respect to one of the carousels and having at ends opposite pads at least one of said pads being suitably spring-loaded, the arms or the associated slides including pairs of rollers following a profile of suitable annular cams located coaxially and inside the hollow shaft and mounted on a fixed support structure and whereby the grippers of the auxiliary carousel receive the necessary closing and opening movement.

12. The machine according to claim 11, wherein the fixed structure supporting the annular cams for the opening and closing movement of the grippers of the first auxiliary carousel is rotatably supported at the ends by the hollow shaft of the first auxiliary carousel and with the end directed towards the base casing projects into the latter and is attached to a fixed fastening lug, the fixed structure having, mounted thereon, longitudinal slide-guiding groups passing through openings of the body of the annular cams and having the cams fixed on the moving element, the cams carrying aligned, nut screws on the body and cooperating with the oppositely threaded sections of a screw parallel to the axis of one of the carousels and with the end directed towards the base casing is supported rotatably by the fixed structure and projects into the casing having keyed onto it, a pinion or other suitable means connected to the kinematic chain allowing adjustment of the opening distance between the jaws of the gripper.

13. The machine according to claim 12, wherein the end of the fixed structure opposite the base casing supporting the annular cams of the first auxiliary carousel projects from the hollow shaft of the first auxiliary carousel and is fixed to the end of a curved structure fixed to the base of the machine, thereby supporting the first auxiliary carousel.

14. The machine according to claim 1, further comprising: in the region of the first auxiliary carousel a fixed external guide holding the roll correctly in the seat and if necessary completing insertion of the roll into the seat when the roll is released by the grippers of the first auxiliary carousel.

15. The machine according to claim 1, wherein the folding means comprises: a nozzle-type bar fixed to the base of the machine and located downstream of the fixed external guide, said fixed external guide temporarily holding the rolls during insertion into the seats of the main carousel, said nozzle type bar delivering a laminar stream of air oriented in a direction opposite to direction of rotation of the main carousel and thereby folding the front edge of the packaging sheet released by the gripper.

16. The machine according to claim 1, wherein the sealing means comprises: a sealing carousel having an axis parallel to the axis of the main carousel and including one or more heat-sealing bars positioned parallel and angularly equidistant from one another and fixed by means of spokes onto a rotational shaft of the sealing carousel, rotating in synchronism and in a direction opposite to a direction of rotation of the main carousel, the rotational shaft of the sealing carousel rotatably and coaxially supported by a first hollow shaft fixed at one end thereof to a box-like structure and integrally including on the opposite side thereof a second hollow shaft parallel to the first hollow shaft and rotatably supported by a bush fixed in cantilever fashion onto the base casing, and the second hollow shaft projecting into the casing, having integrally connected thereto a lever arm connected to an oscillation servo-control system mounted on the base and projecting from said first hollow shaft a coaxial shaft which, having an end toothed pulley, for connecting one end thereof to the kinematic actuating chain and connected at the opposite end thereof to a gear located in the box-like structure operating the sealing carousel rotational shaft projecting at the rear of the box-like structure cooperating with an assembly comprising a ring and brush collector and an optional rotating distributor for providing the sealing bars with electrical power and temperature-regulating control.

17. The machine according to claim 16, wherein the oscillation servo-control system comprises: a pair of cylinder and piston groups having different strokes and aligned with one another and fixed together to the body and hinged with a first stem to the lever arm of the sealing carousel and hinged with a second stem to the base of the machine, and means providing selective or simultaneous powering of the cylinder and piston groups, such that the bars follow the packaging to be sealed with necessary contact pressure for performing heat-sealing.

18. The machine according to claim 1, further comprising fixed guiding means located downstream of the sealing means for fixing together the transverse edges of the packaging sheet, and for retaining the packaged rolls in the seats of the main carousel, and accompanying the rolls until they are unloaded towards the final sealing means.

19. The machine according to claim 1, wherein the second adjustable means are mounted on pairs of vertical shoulders arranged parallel and equidistant with respect to the vertical center line of the main carousel and travelling by means of bushes on at least one pair of guiding rods parallel to the axis of the main carousel and fixed at one end in cantilever fashion onto the base casing, said shoulders provided with nut screws cooperating with oppositely threaded sections of at least one pair of screws located parallel to the axis of the main carousel and supported rotatably at one end by the base casing and projecting into this casing for connection to the kinematic chain whereby depending on the size of the rolls to be packaged the position of the folding devices mounted on the shoulders can be adapted in a self-centering manner with respect to the ends of the rolls.

20. The machine according to claim 19, wherein the folding means comprises: first dynamic folding devices comprising a pair of segments rotating on axes oriented in a substantially radial direction with respect to the main carousel and formed by the output shaft of bevel-gearing drive systems connected to the shoulders, the bevel-gearing drive systems having a horizontal hollow spindle keyed for axial sliding on a shaft parallel to the axis of the main carousel and connected by a resilient coupling at one end thereof to a toothed pulley rotatably mounted in the base casing, the segments acting on a rear middle portion of the ends projecting from the roll packaging sheet thereby folding these portions onto the ends of the sheet, while in synchronism opposite front middle portions of the ends of the packaging are acted on by first fixed folding devices mounted on the adjustable shoulders and thereby folding these front portions onto the rear portions folded by the first dynamic folding devices and keeping these portions folded on the ends of the roll, such that the same dynamic folding devices are able to release the roll in order to repeat a new working cycle.

21. The machine according to claim 20, further comprising second dynamic folding devices located downstream of the first fixed folding devices comprising vertical blades substantially parallel to the ends of the rolls located in the seats of the main carousel and mounted on means displacing them with a revolving movement about an axis parallel to the axis of said main carousel for initiating folding of the upper middle portions of the projecting end sections of the packaging.

22. The machine according to claim 21, wherein the blades of the second dynamic folding devices are rotatably mounted parallel to the axis of the main carousel on the ends of respective arms, the arms rotatably mounted on the shoulders parallel to the axis of the main carousel, the axes of rotation of the blades having keyed thereon respective toothed pulleys connected by means of respective belts to corresponding toothed pulleys fixed on the shoulders coaxially with respect to the axes of rotation of the arms, the axes of rotation of the arms having keyed respective toothed pulleys connected by means of toothed belts to corresponding toothed pulleys mounted rotatably on the shoulders and keyed for axial travel on a shaft parallel to the axis of the main carousel and having one end thereof rotatably supported by the base casing, the end thereof having keyed onto it a toothed pulley connected to the kinematic chain of the machine, whereby revolving movement is transmitted to the blades.

23. The machine according to claim 21, wherein second fixed folding means acting on the upper middle portions of the packaging complete folding of the upper middle packaging portions, the action of the first folding devices gradually decreases, the opposite and bottom portions of the packaging are gradually acted on and folded by third fixed folding device, said second and third fixed folding devices terminating in tapered sections leaving free central end portions of the packaging whereby the packaged roll is gripped axially by the grippers with a self-centering movement of the second auxiliary carousel.

24. The machine according to claim 1, wherein the second auxiliary carousel inserts the rolls between a pair of parallel, horizontal-axis conveyors arranged above one another and inserts the free end portions of the packaged rolls between fixed guides whereby the fixed guides take over control of the packaged rolls and the grippers of the second auxiliary carousel are able to open and release the rolls the parallel conveyors being motor-driven, feeding the packaged rolls parallel to their axis, the fixed guides stopping and internal parallel sections of a pair of vertical-axis conveyors feeding the rolls, the packaging folded end portions being sealed by heat-sealing bars acting on the internal sections of the conveyors, and the sealed zones being cooled by cooling means.

25. The machine according to claim 20, wherein the base casing includes a centralized drive system operating the shaft by means of a positive transmission, the shaft having a toothed pulley transmitting movement to the first dynamic folding devices, said pulley operating, by means of a belt having internal or external toothing, the toothed pulley of the sealing carousel, the toothed pulley of the first auxiliary carousel which inserts the rolls into the main carousel, a toothed pulley operating the packaging sheet supply means, the toothed pulley of the main carousel, the toothed pulley of the second auxiliary carousel, and a toothed pulley providing movement for operation of the toothed pulley of the second dynamic folding devices with a positive transmission.

26. The machine according to claim 25, wherein the toothed pulley operating the first dynamic folding devices also drives a belt with external toothing driven first on a pair of idle pulleys mounted on a horizontal slide and then on further idle and fixed pulleys whereby said belt cooperates via its toothing with an arc of the toothed pulley keyed onto the shaft allowing adjustment of the width of the seats of the main carousel according to the variation in size of rolls to be packaged, whereby said toothed pulley rotates in synchronism with the pulley of the main carousel by acting on the slide by means of a screw/nut-screw adjusting system and by means of a drive whereby the shaft can be phase-displaced with respect to the axis of the main carousel, in order to decrease or increase the width of the seats of the main carousel.

27. The machine according to claim 19, wherein the screws adjusting the first and second auxiliary carousel and those of the shoulders are connected by means of positive transmissions to a centralized drive.

28. The machine according to claim 19, wherein the folding means form a puckered closure maintained by fixed folding devices, whereby the packaged rolls may then be gripped at the ends by the grippers of the carousel.

29. The machine according to claim 1, further comprising inserting means whereby before sealing of the folded ends of the packaging, the excess central portions of these folded ends of the package are inserted inside the axial cavity of the rolls.

30. The machine according to claim 1, wherein paper comprises the packaging sheet for the rolls, the paper if necessary being treated, for the purposes of sealing, with glues or thermal glues.

* * * * *